US010145603B2

(12) United States Patent
Kim et al.

(10) Patent No.: US 10,145,603 B2
(45) Date of Patent: Dec. 4, 2018

(54) REFRIGERATOR AND REFRIGERATOR DOOR ASSEMBLY

(71) Applicant: SAMSUNG ELECTRONICS CO., LTD., Suwon-si, Gyeonggi-do (KR)

(72) Inventors: Sung Mo Kim, Ansan-si (KR); Sun Gyou Lee, Gwangsan-gu (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/541,596

(22) PCT Filed: Dec. 30, 2015

(86) PCT No.: PCT/KR2015/014489
§ 371 (c)(1),
(2) Date: Jul. 5, 2017

(87) PCT Pub. No.: WO2016/111499
PCT Pub. Date: Jul. 14, 2016

(65) Prior Publication Data

US 2017/0370631 A1 Dec. 28, 2017

(30) Foreign Application Priority Data

Jan. 5, 2015 (KR) ..... 10-2015-0000410

(51) Int. Cl.
*F25D 23/02* (2006.01)
*F25D 23/00* (2006.01)
*A47F 3/04* (2006.01)

(52) U.S. Cl.
CPC ..... *F25D 23/028* (2013.01); *F25D 23/006* (2013.01); *F25D 23/02* (2013.01);
(Continued)

(58) Field of Classification Search
CPC .... F25D 23/02; F25D 23/028; F25D 2323/02; A47F 3/043
See application file for complete search history.

(56) References Cited

U.S. PATENT DOCUMENTS

2004/0194253 A1* 10/2004 Jung ..... F25D 23/02 16/87.2
2016/0209110 A1* 7/2016 Cho ..... F25D 23/062
2017/0082349 A1* 3/2017 Jung ..... F25D 23/028

FOREIGN PATENT DOCUMENTS

CN 101487654 A 7/2009
DE 4239961 A1 * 6/1994 ..... A47B 95/02
(Continued)

OTHER PUBLICATIONS

European Search Report dated Oct. 9, 2017, in corresponding European Patent Application No. 15877219.4.
(Continued)

*Primary Examiner* — Andrew M Roersma
(74) *Attorney, Agent, or Firm* — Staas & Halsey LLP

(57) ABSTRACT

A refrigerator wherein a front part of a storage chamber opens; and a door assembly is rotatably coupled with a main body, and configured to open and close the open front part of the storage chamber, wherein the door assembly includes a door plate including a front plate and a side plate bent in a rear direction from both side edges of the front plate, wherein a bent portion is formed in an upper end of the front plate, a door cap is configured to cover a top of the door plate, wherein a gripping groove is formed between the door cap and the bent portion, the griping groove opening in a up direction; and a door cap support includes a coupling portion coupled with the door cap, and is fixed at the bent portion such that the coupling portion is positioned behind the bent portion.

16 Claims, 29 Drawing Sheets

(52) U.S. Cl.
CPC ..... *A47F 3/043* (2013.01); *F25D 2400/04* (2013.01); *F25D 2400/36* (2013.01)

(56) References Cited

FOREIGN PATENT DOCUMENTS

| | | | | | |
|---|---|---|---|---|---|
| DE | 102010028414 | A1 * | 11/2011 | ..... | F25D 23/085 |
| EP | 2 182 311 | A2 | 5/2010 | | |
| EP | 2 182 311 | A3 | 9/2017 | | |
| JP | 64-84079 | | 3/1989 | | |
| JP | 5-322438 | | 12/1993 | | |
| JP | 2004-116788 | | 4/2004 | | |
| JP | 2006194545 | A * | 7/2006 | ..... | F25D 23/02 |
| KR | 10-2007-0062846 | | 6/2007 | | |
| KR | 10-2008-0001249 | | 1/2008 | | |
| KR | 10-0804611 | | 2/2008 | | |
| KR | 10-2014-0139282 | | 12/2014 | | |
| WO | WO-2010100925 | A1 * | 9/2010 | ..... | F25D 23/028 |
| WO | WO-2015015355 | A1 * | 2/2015 | ..... | E05B 1/0015 |
| WO | WO-2015163193 | A1 * | 10/2015 | ..... | F25D 23/02 |

OTHER PUBLICATIONS

European Office Action dated Nov. 27, 2017, in corresponding European Patent Application No. 15 877 219.4.
International Search Report dated Apr. 4, 2016, in corresponding International Patent Application No. PCT/KR2015/014489.
International Written Opinion, PCT/ISA/237, dated Apr. 4, 2016, in corresponding International Patent Application No. PCT/KR2015/014489.
European Communication dated Oct. 15, 2018 in European Patent Application No. 15877219.4.

* cited by examiner

[Fig. 1]
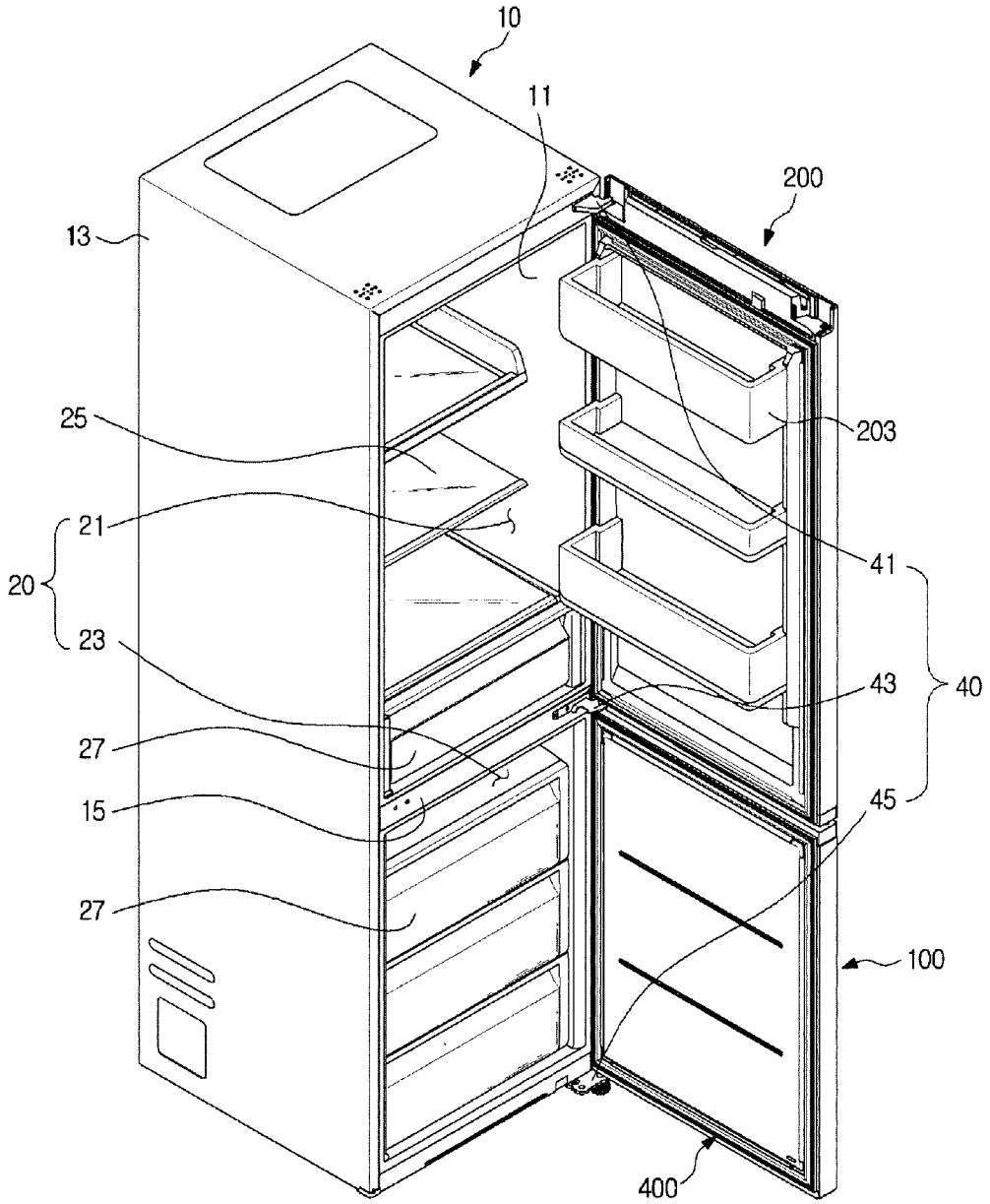

[Fig. 2]
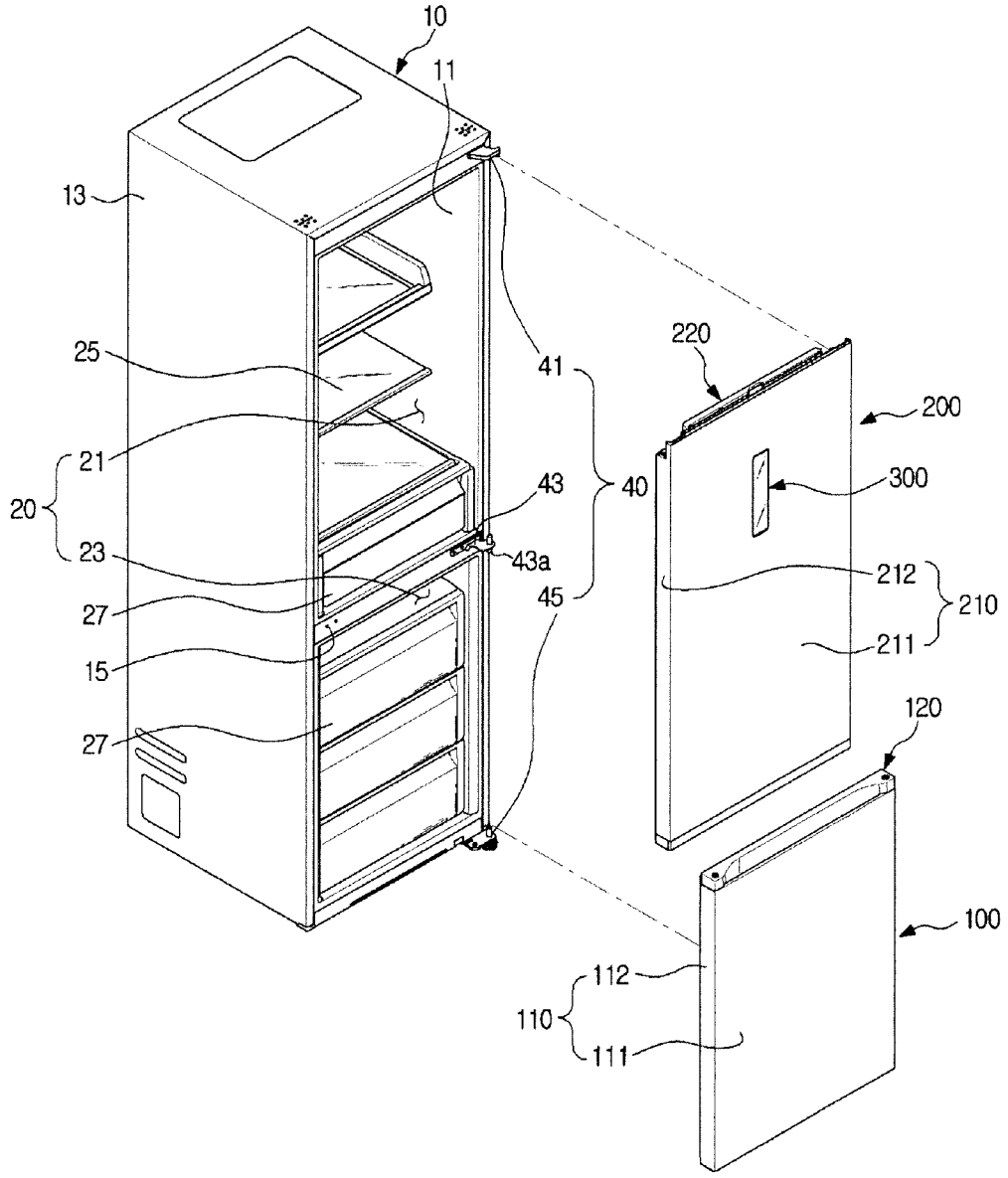

[Fig. 3]
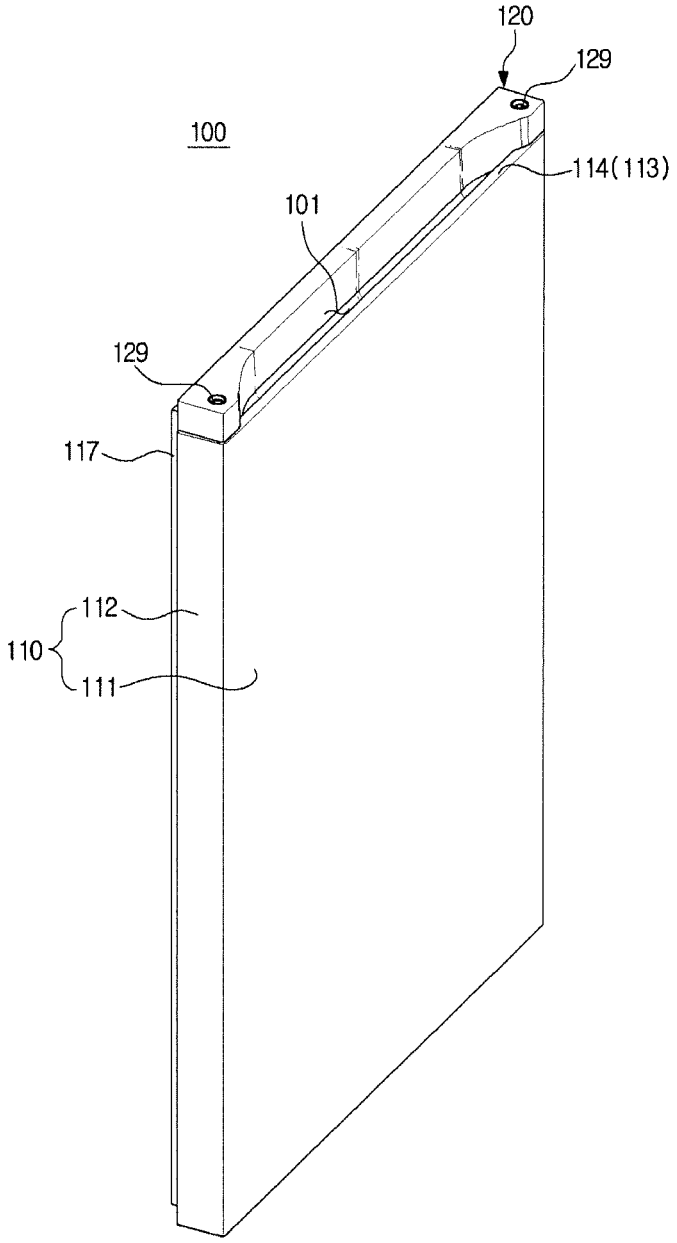

[Fig. 4]
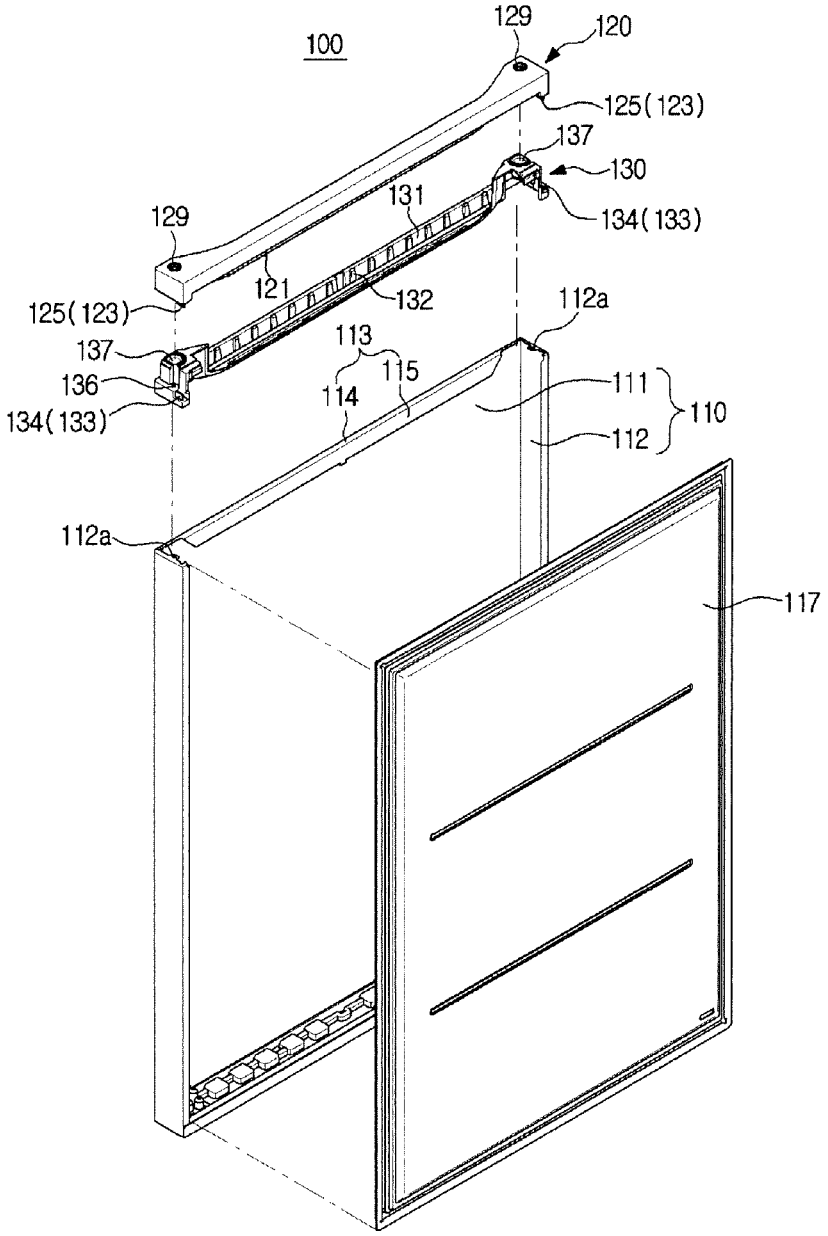

[Fig. 5]
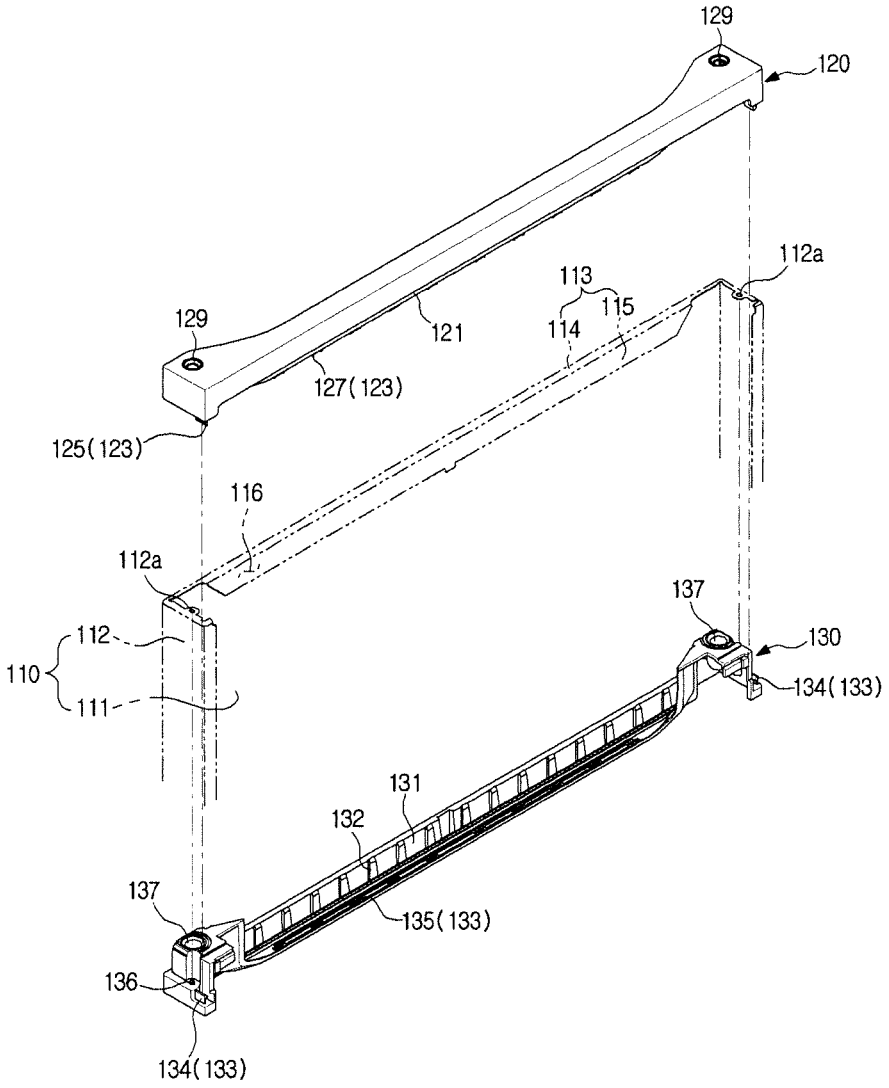

[Fig. 6]
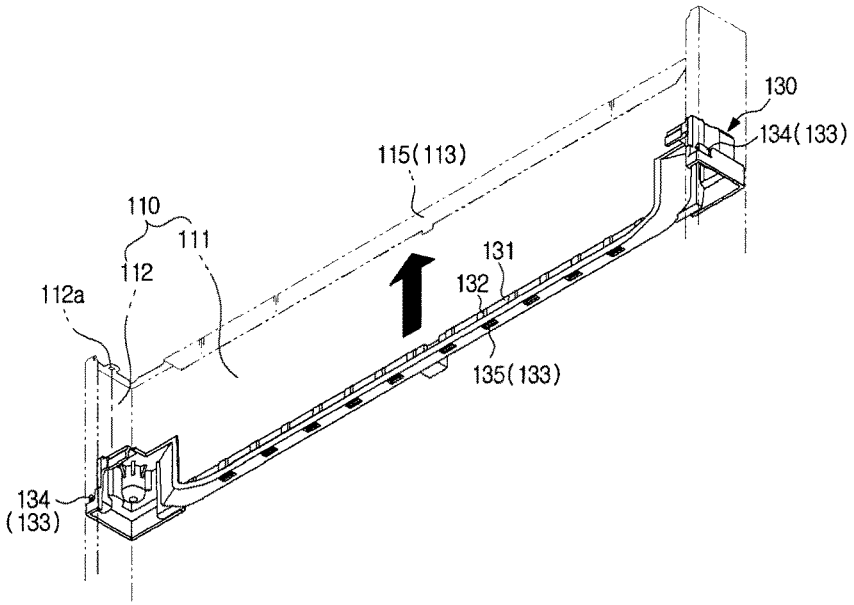
[Fig. 7]
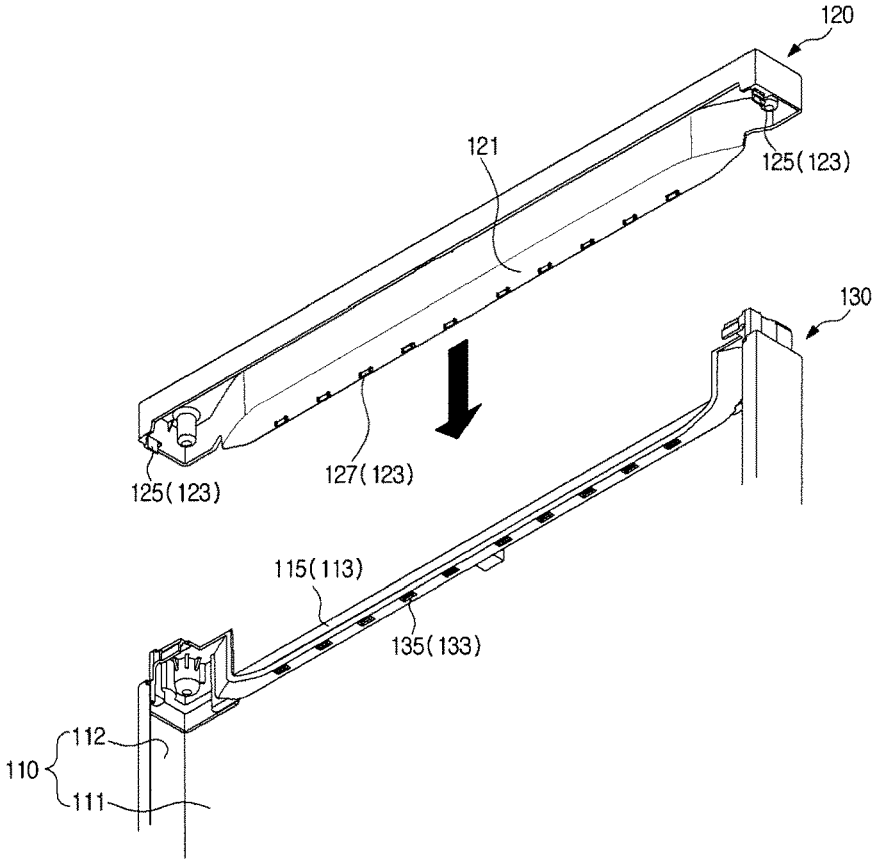

[Fig. 8]
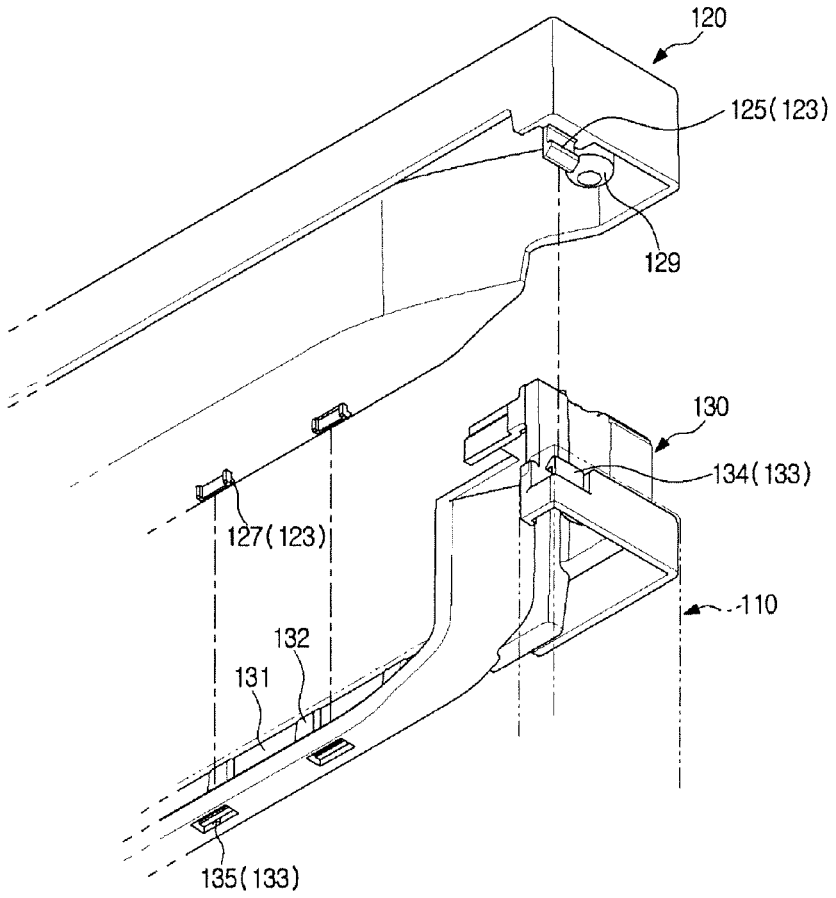

[Fig. 9]
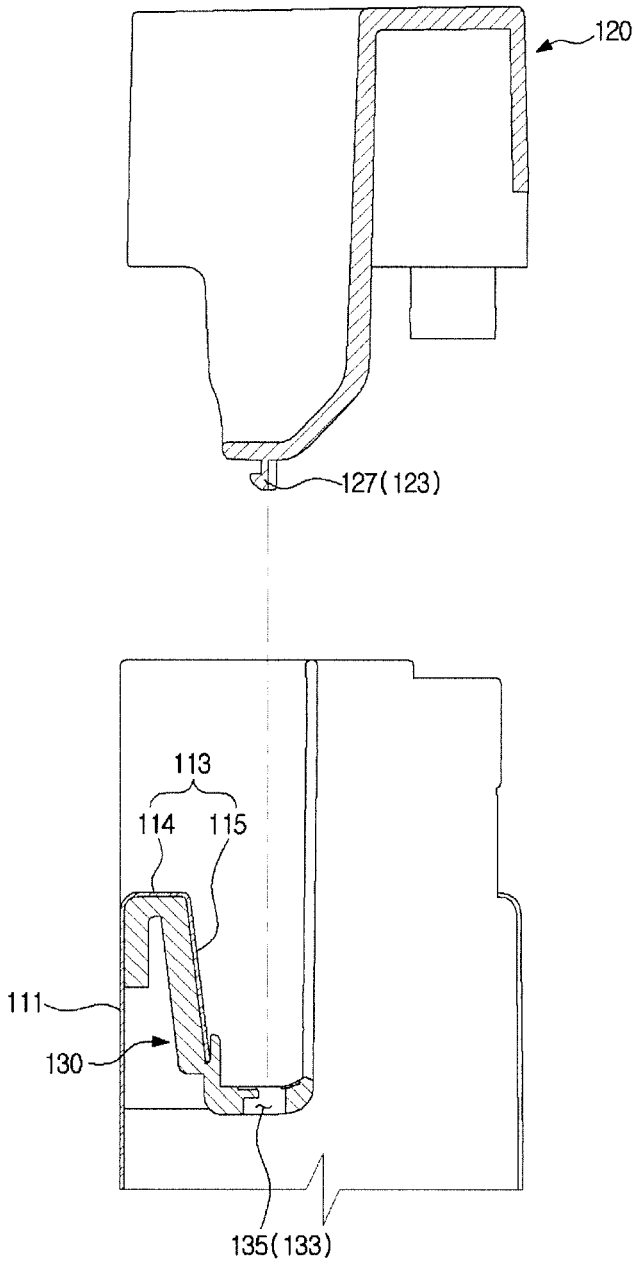

[Fig. 10]
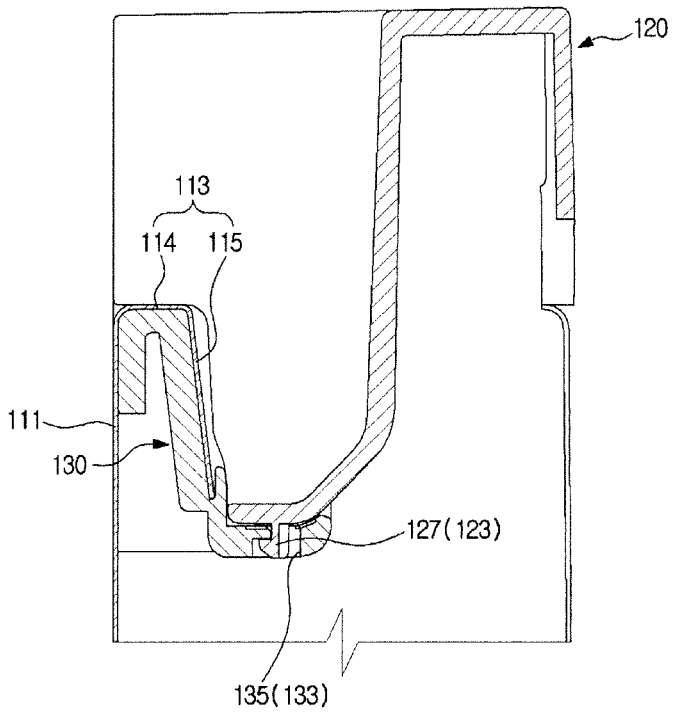

[Fig. 11]
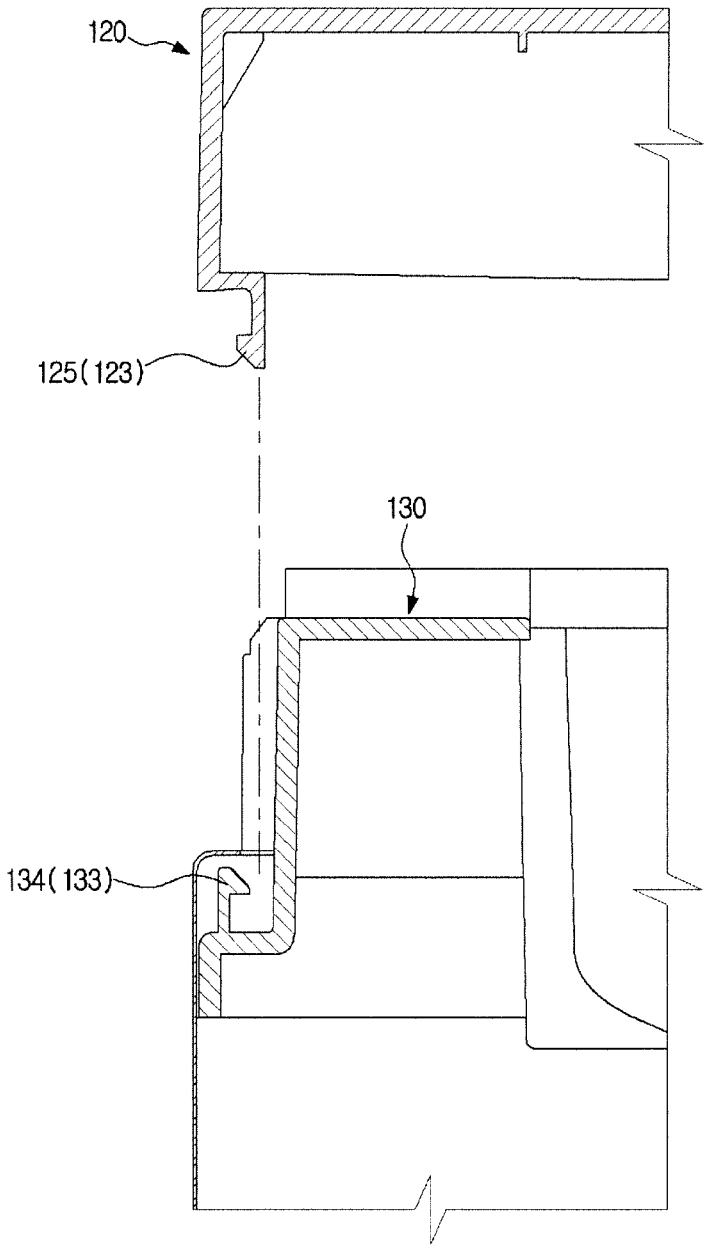

[Fig. 12]
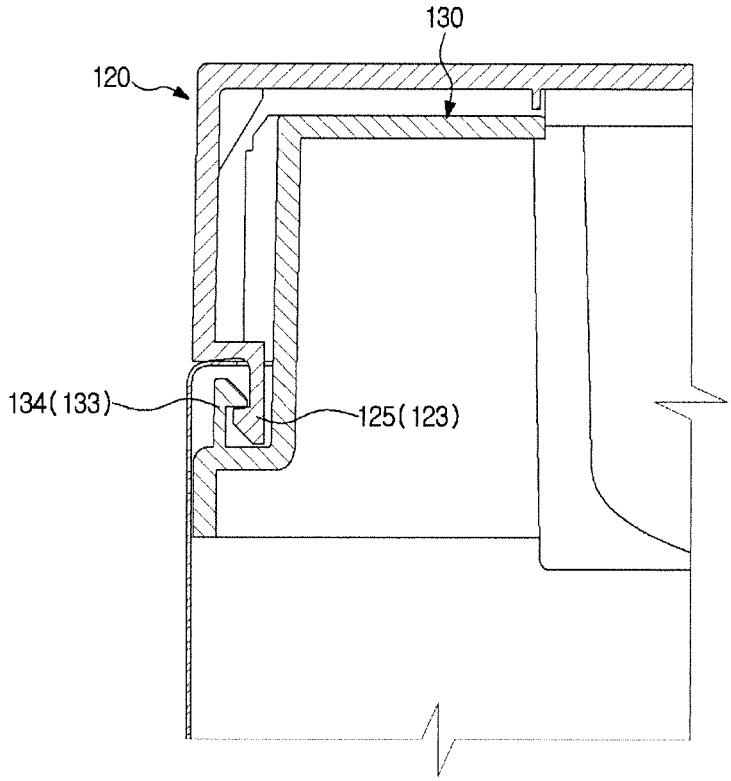

[Fig. 13]
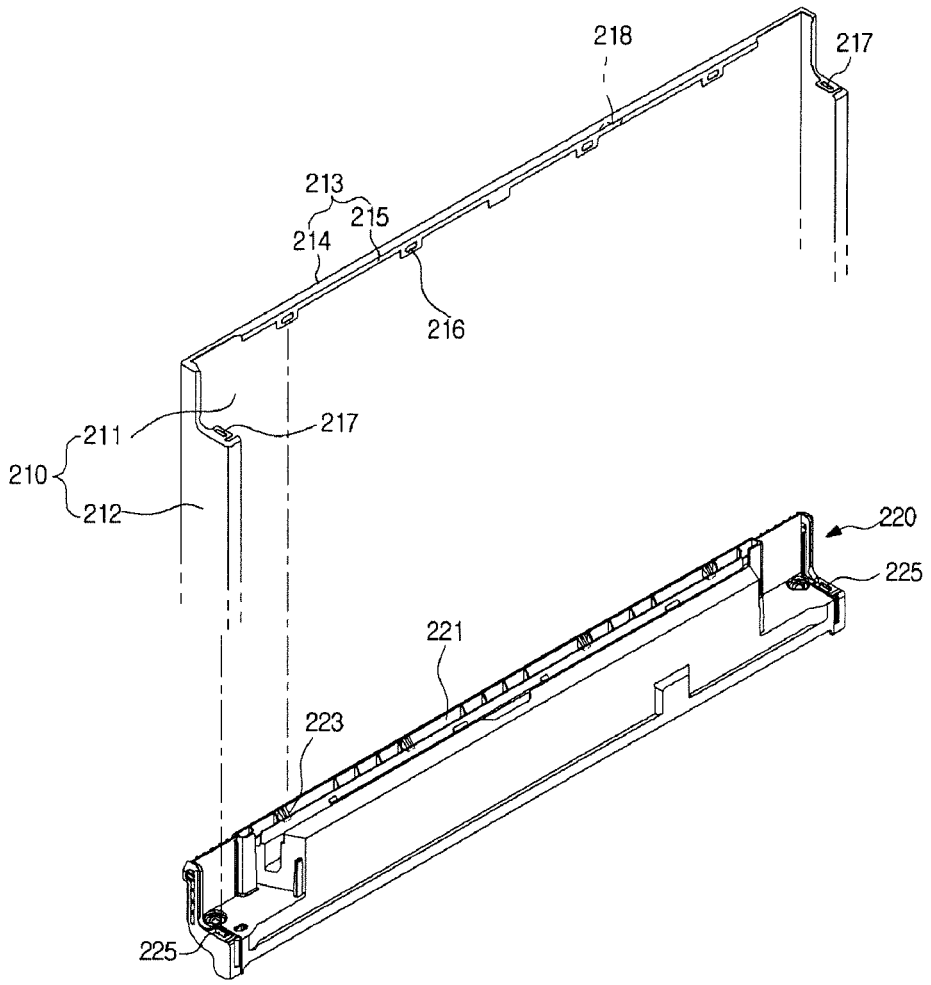

[Fig. 14]
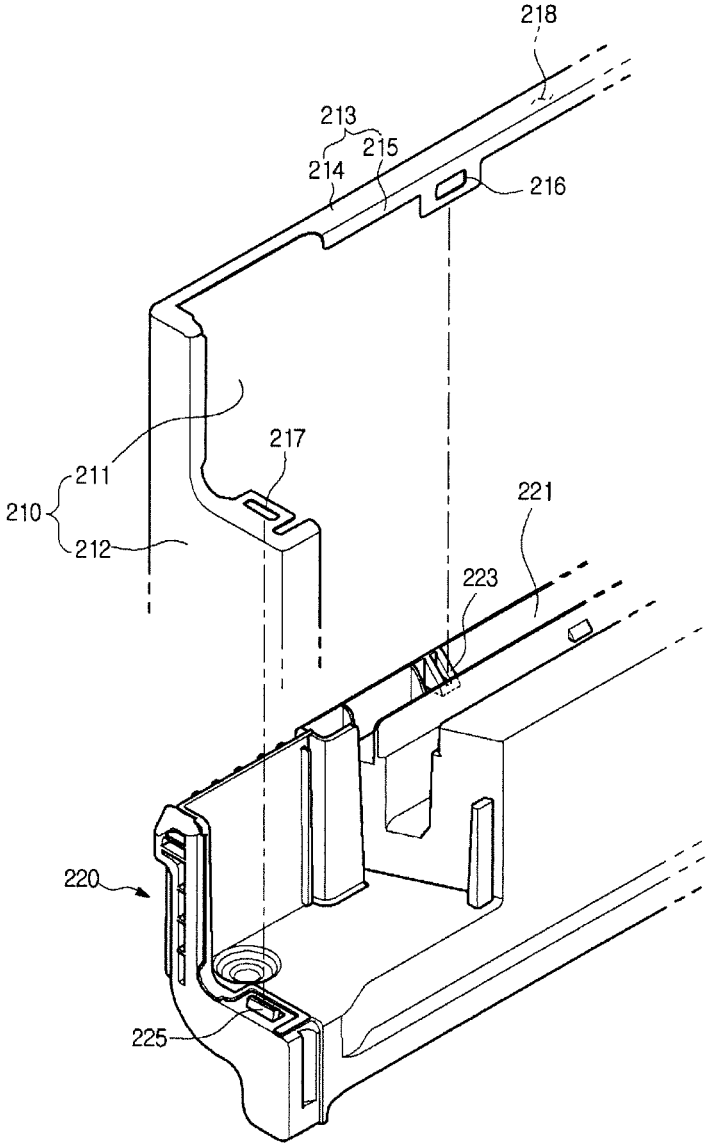

[Fig. 15]
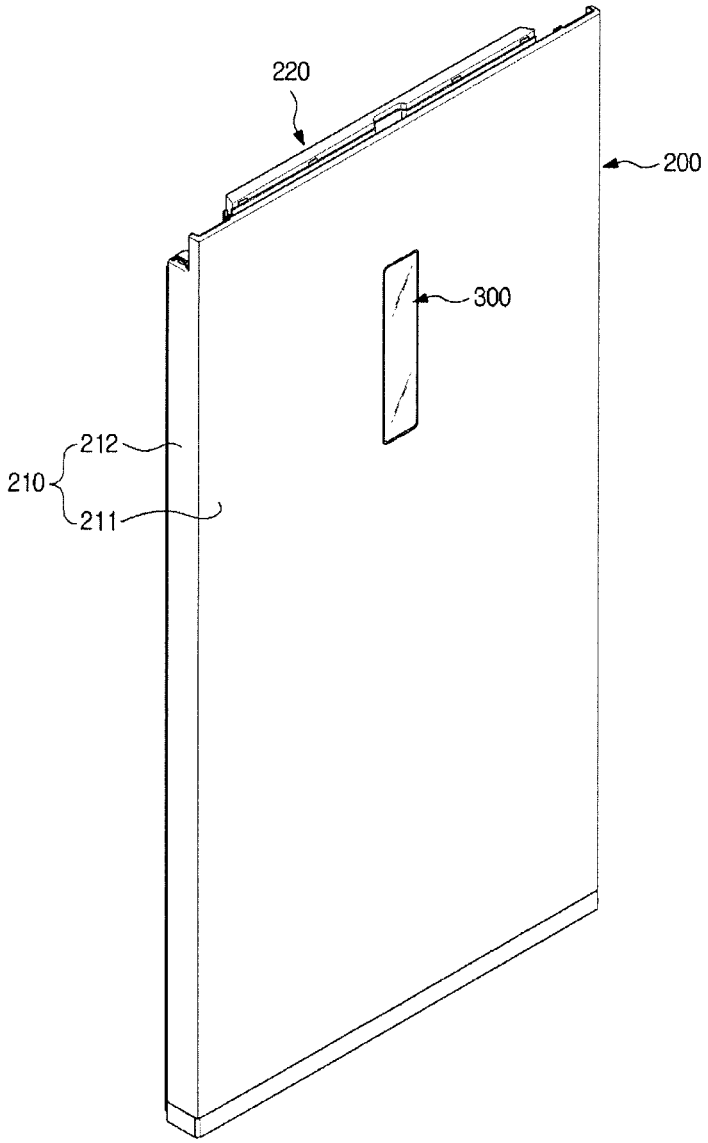

[Fig. 16]
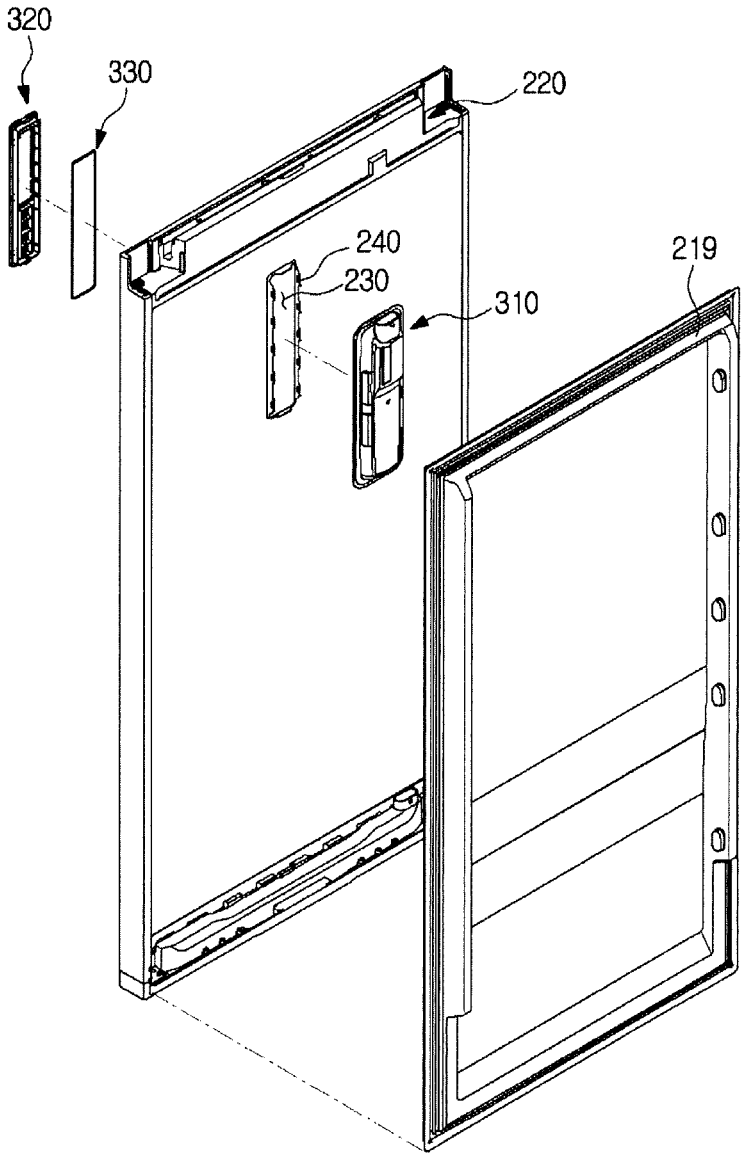

[Fig. 17]
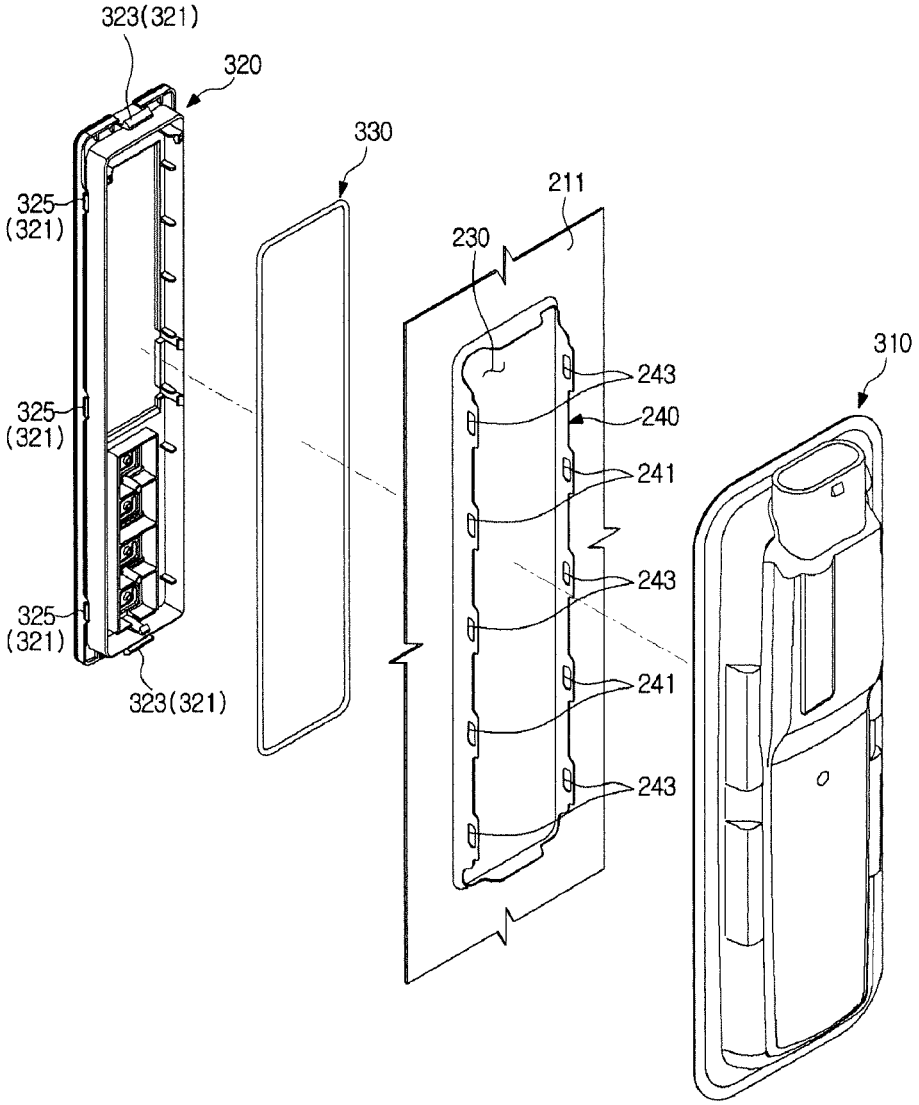

[Fig. 18]
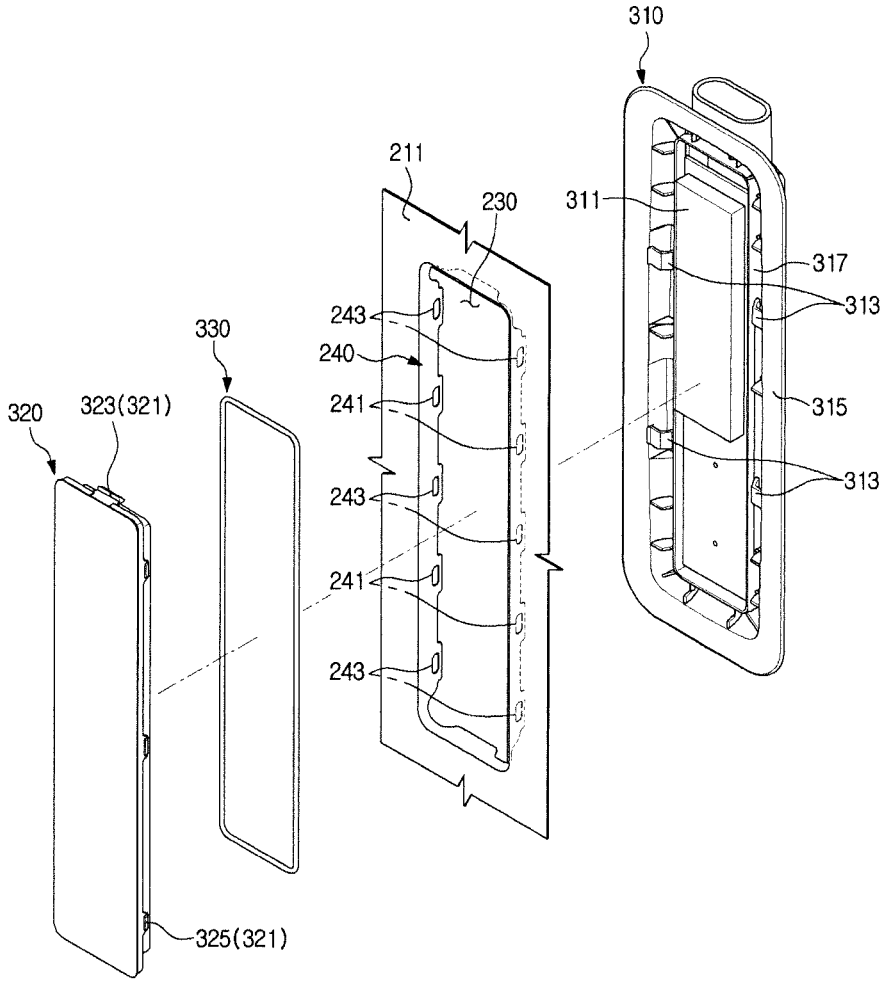

[Fig. 19]
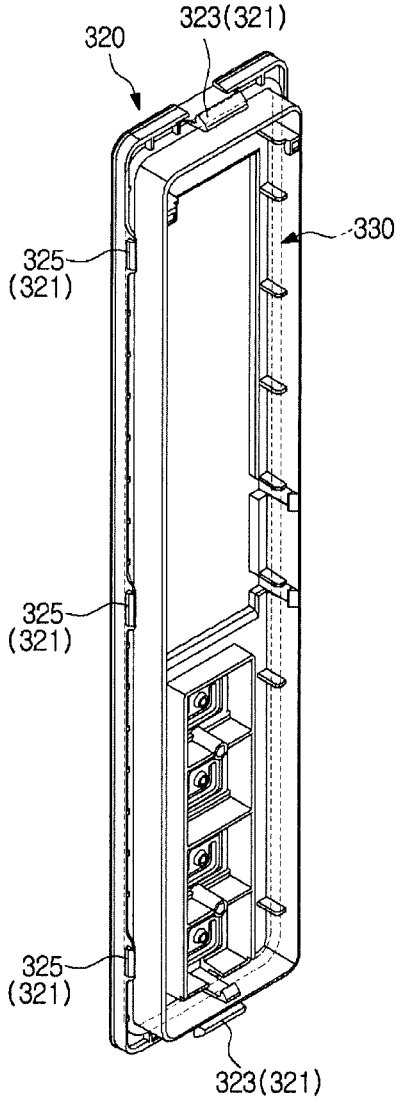

[Fig. 20]
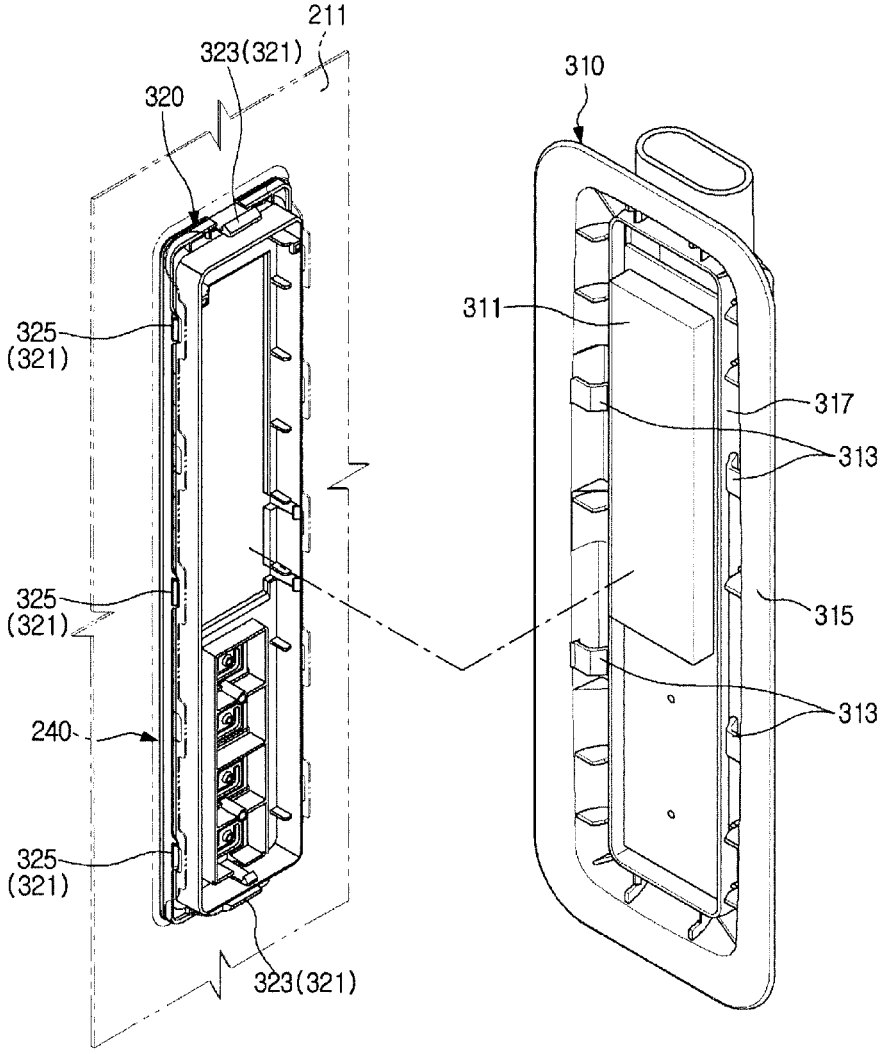

[Fig. 21]
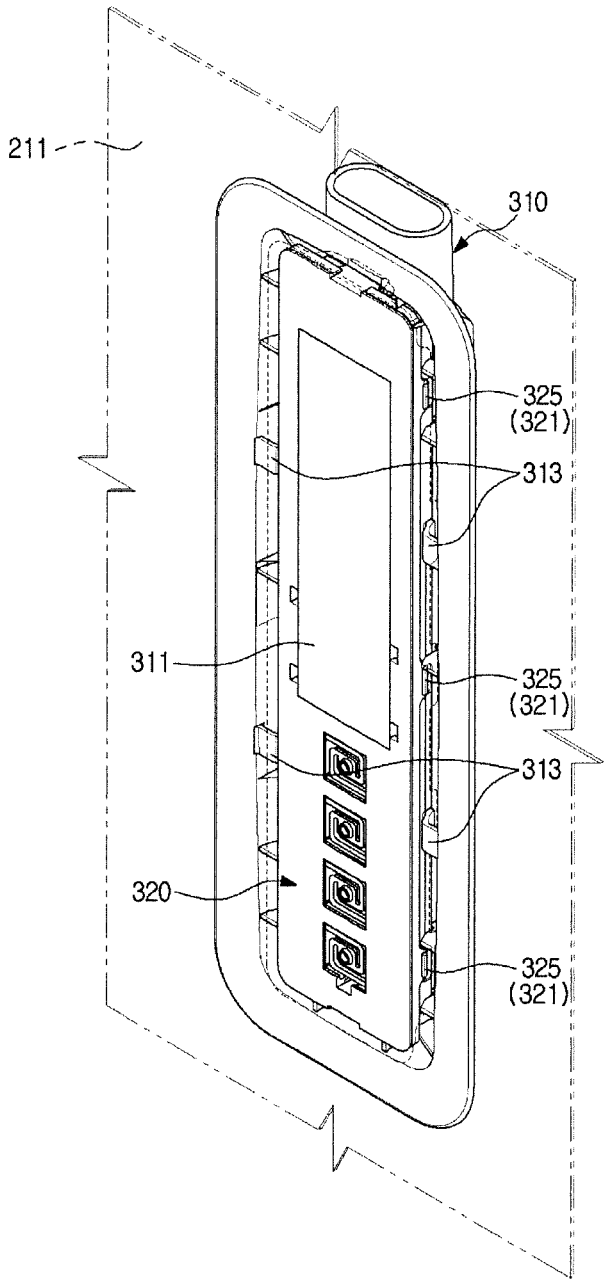

[Fig. 22]
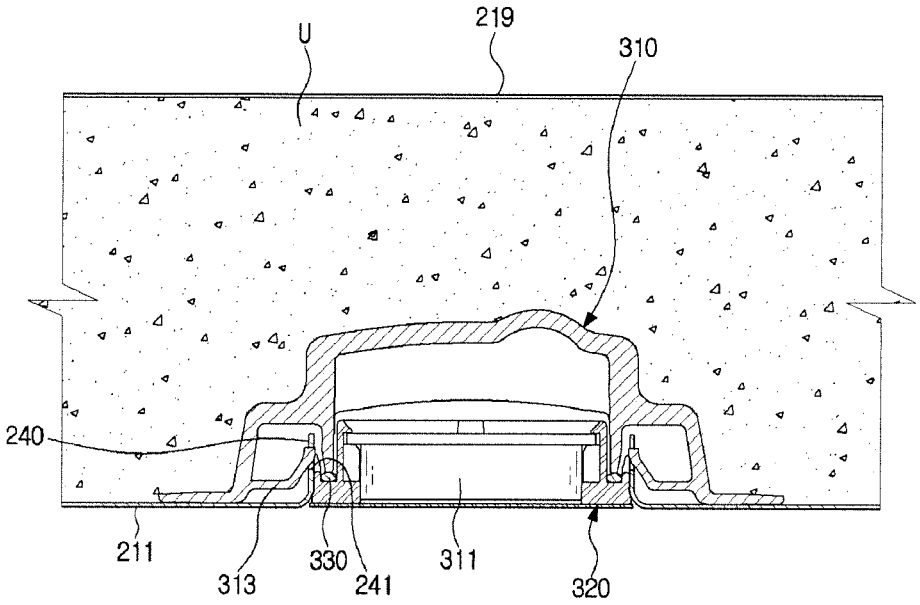
[Fig. 23]
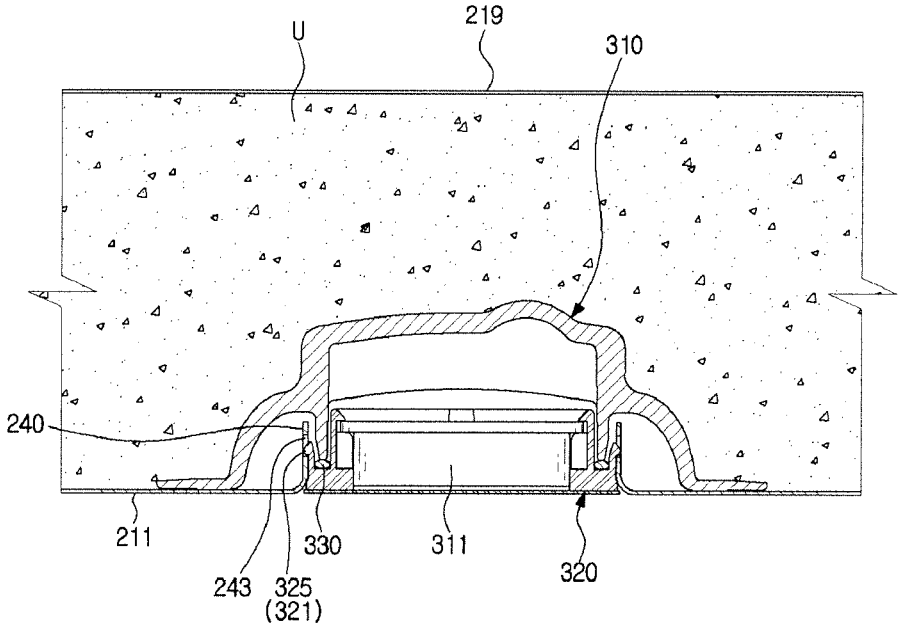

[Fig. 24]
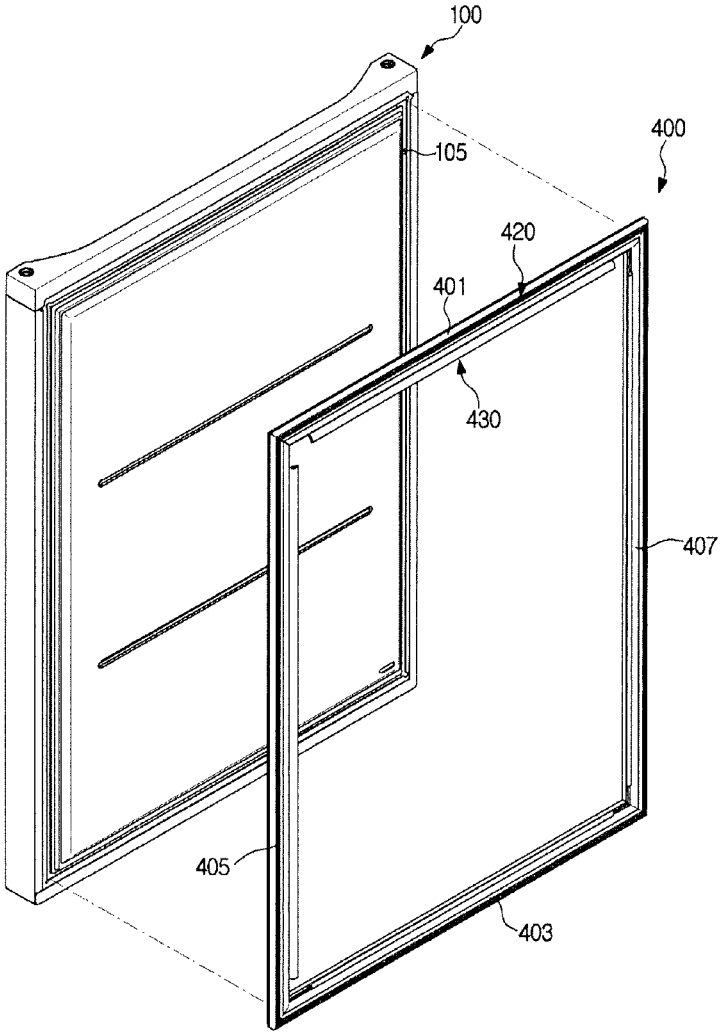

[Fig. 25]
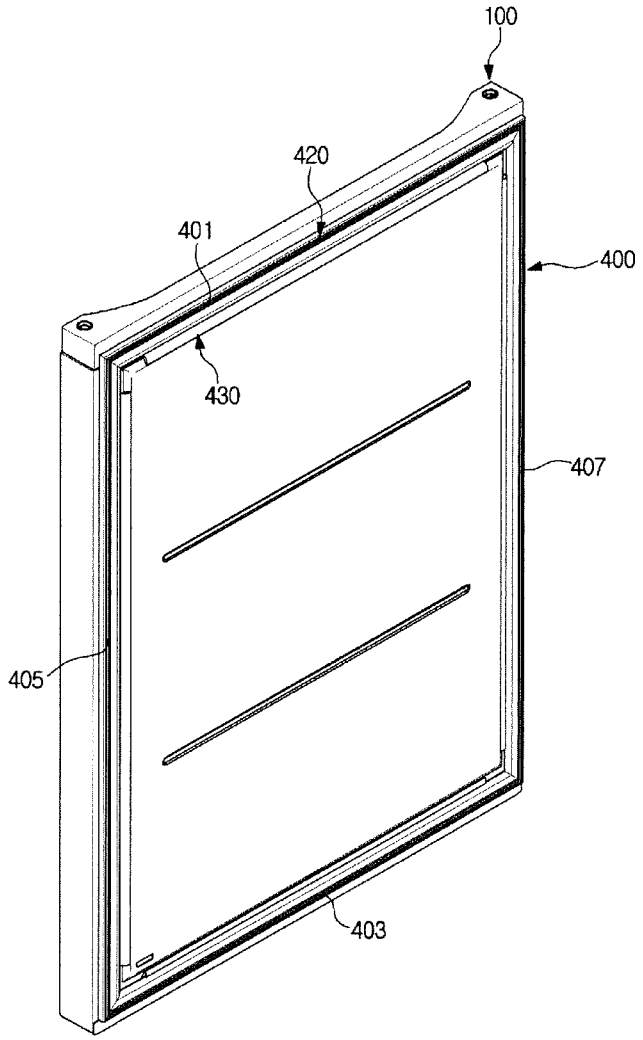

[Fig. 26]
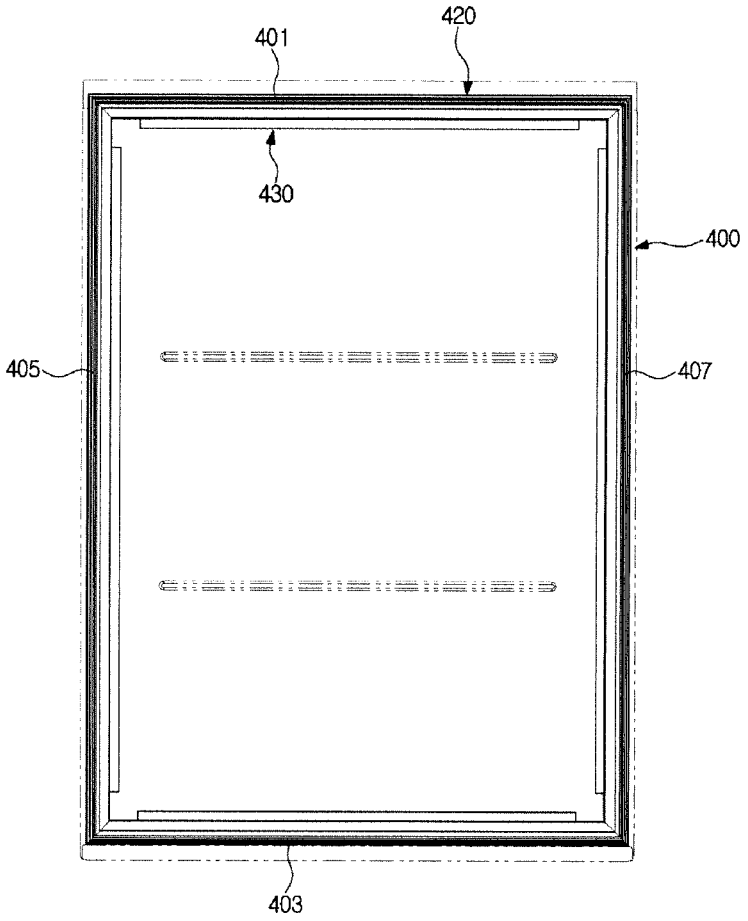

[Fig. 27]
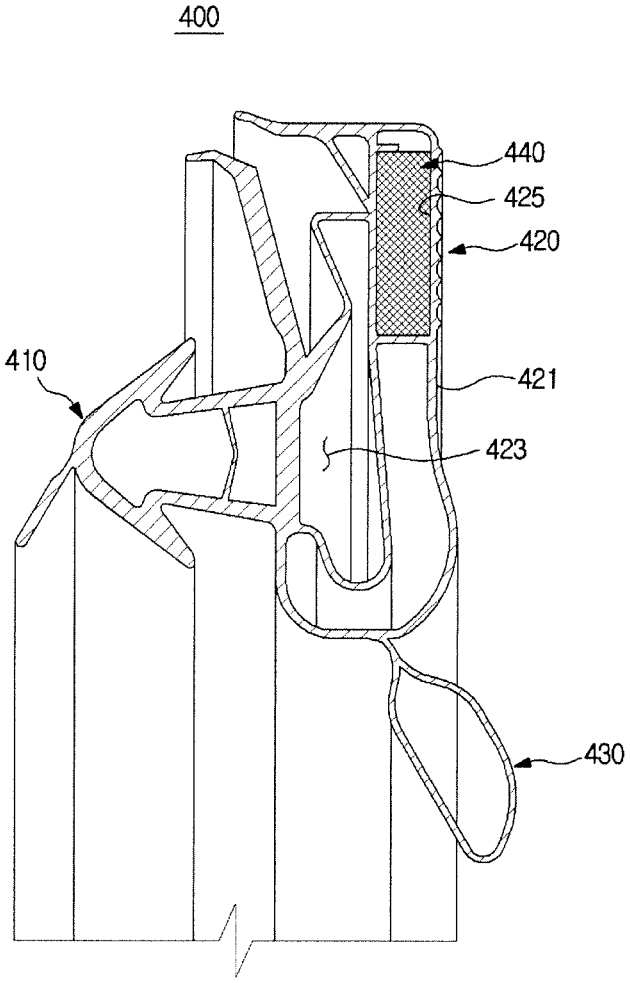

[Fig. 28]
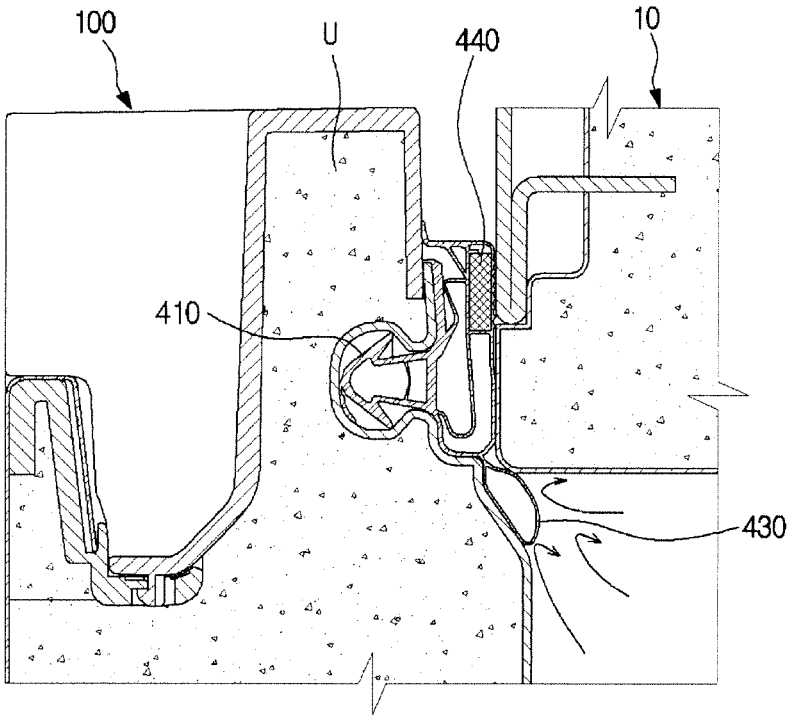
[Fig. 29]
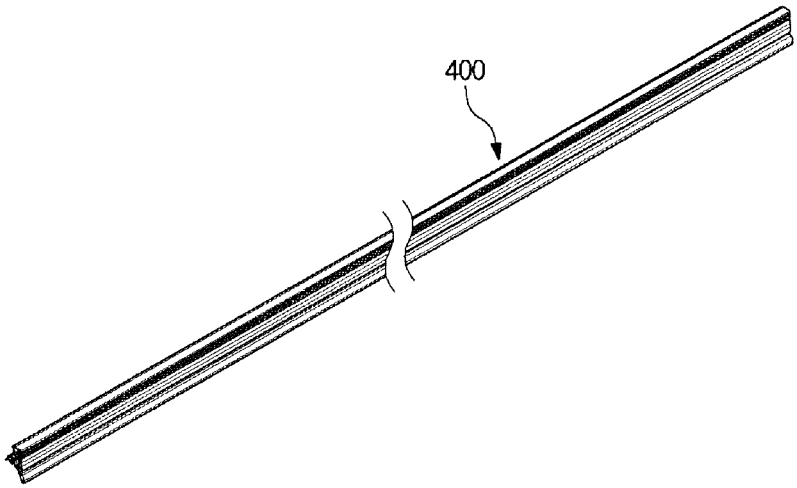

[Fig. 30]
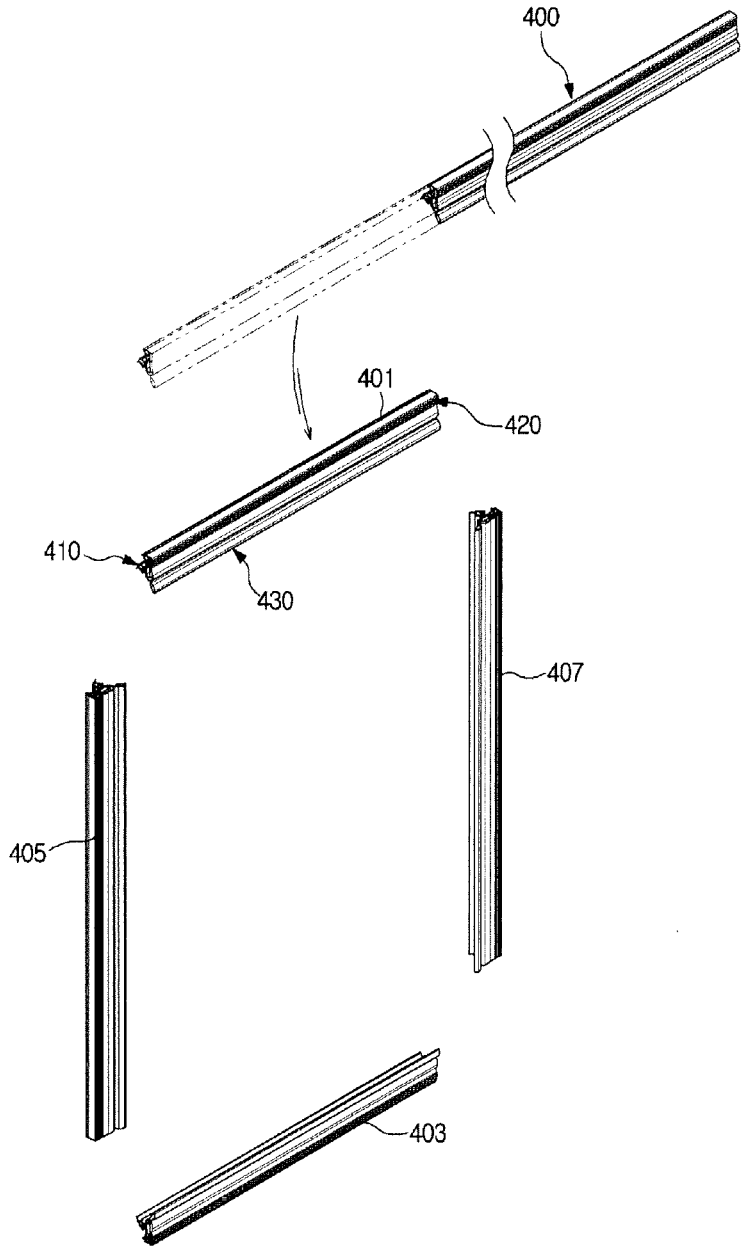

[Fig. 31]
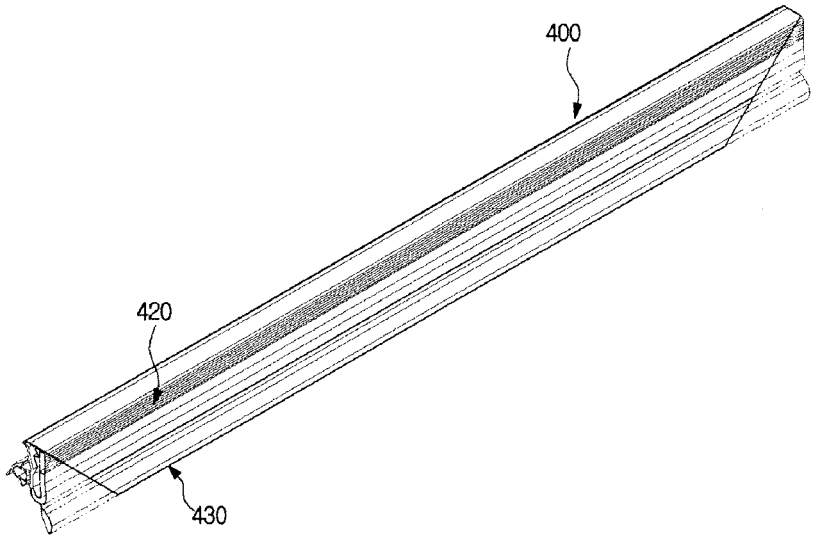
[Fig. 32]
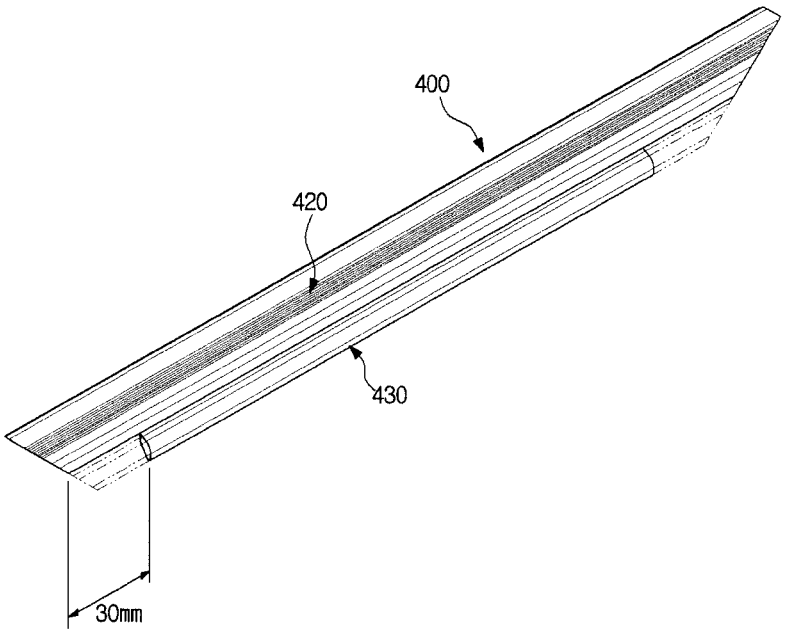

[Fig. 33]
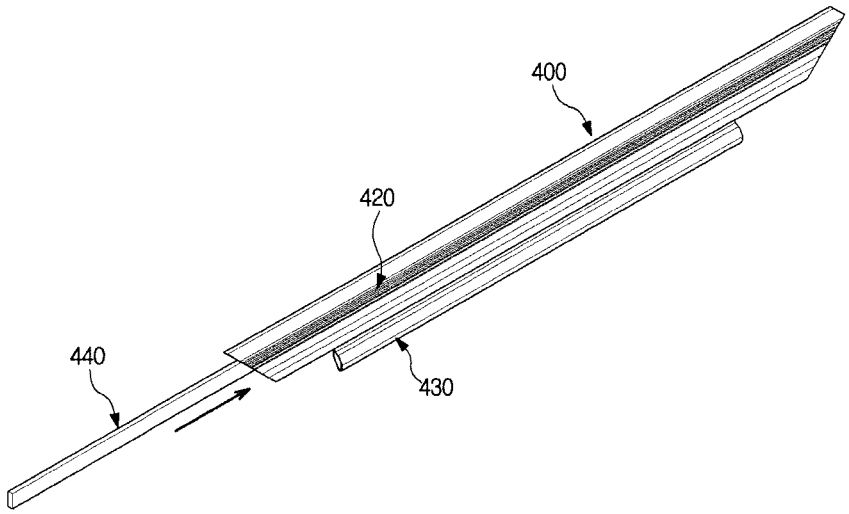
[Fig. 34]
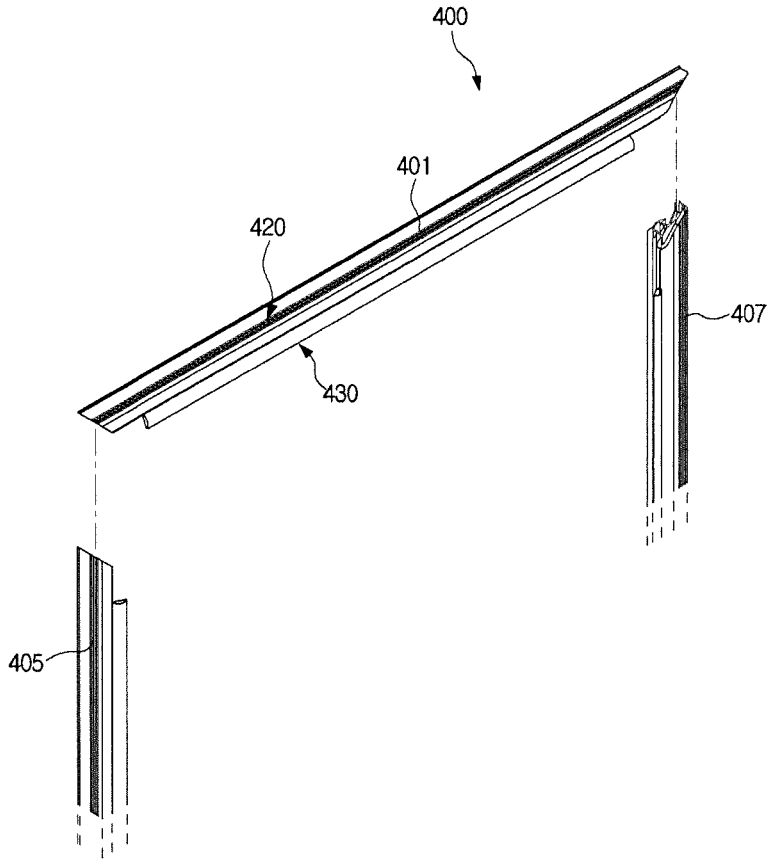

REFRIGERATOR AND REFRIGERATOR DOOR ASSEMBLY

CROSS-REFERENCE TO RELATED APPLICATION

This application is a U.S. National Stage Application which claims the benefit under 35 U.S.C. § 371 of PCT International Patent Application No PCT/KR2015/014489, filed Dec. 30, 2015, which claims the foreign priority benefit under 35 U.S.C. § 119 of Korean Patent Application No. 10-2015-0000410, filed Jan. 5, 2015, the contents of which are incorporated herein by reference.

TECHNICAL FIELD

The present disclosure relates to a refrigerator having an improved coupling structure of a door plate and a door cap for improving the quality of the external appearance, and a door assembly of the refrigerator.

BACKGROUND ART

In general, a refrigerator includes a main body having an inner cabinet and an outer cabinet, a storage chamber formed by the inner cabinet, and a cool-air supply apparatus for supplying cool air to the storage chamber to store food fresh.

The inside temperature of the storage chamber is maintained within a specific temperature range required to store food fresh. Also, the front part of the storage chamber of the refrigerator opens, and the open front part of the storage chamber is closed by a door at ordinary time in order to maintain the inside temperature of the storage chamber.

The storage chamber is partitioned into a refrigerating chamber which is the upper storage chamber and a freezing chamber which is the lower storage chamber by a partition wall, and the refrigerating chamber and the freezing chamber are opened or closed by a refrigerating chamber door and a freezing chamber door, respectively.

The freezing chamber door includes a door plate forming the front and side surfaces of the freezing chamber door, and a door cap covering the top of the door plate, and a handle of the freezing chamber door is provided by a gripping groove formed in the door cap and positioned at the upper portion of the freezing chamber door.

If the door cap including the gripping groove is coupled with the upper portion of the door plate, a border of a part at which the door cap is coupled with the door plate is exposed on the front surface of the freezing chamber door. Accordingly, the quality of the external appearance may deteriorate, and foreign materials may be collected through the border of the part at which the door cap is coupled with the door plate.

DISCLOSURE

Technical Problem

An aspect of the present disclosure is to provide a refrigerator having an improved coupling structure of a door plate and a door cap so that a border made in a coupling area of the door plate and the door cap is not exposed on the front surface of the refrigerator, and a door assembly of the refrigerator.

Technical Solution

In accordance with an aspect of the present disclosure, a refrigerator includes a main body; a storage chamber formed in the inside of the main body, wherein a front part of the storage chamber opens; and a door assembly rotatably coupled with the main body, and configured to open and close the open front part of the storage chamber, wherein the door assembly includes a door plate including a front plate and a side plate bent in a rear direction from both side edges of the front plate, wherein a bent portion is formed in an upper end of the front plate, a door cap configured to cover a top of the door plate, wherein a gripping groove is formed between the door cap and the bent portion, the griping groove opening in a up direction; and a door cap support including a coupling portion coupled with the door cap, and fixed at the bent portion such that the coupling portion is positioned behind the bent portion.

The bent portion may include a first bent portion bent in the rear direction from a top end of the front plate to be at right angles with respect to the front plate, and a second bent portion bent downward from an end of the first bent portion to be at right angles with respect to the first bent portion.

A fixing groove may be formed between the front plate and the second bent portion, the fixing groove opening in a down direction, so that the door cap support is inserted into the fixing groove from bottom to top and fixed at the fixing groove.

The door cap support may include an insertion portion inserted into the fixing groove, and a protrusion rib protruding from at least one of a front surface and a rear surface of the insertion portion.

The door cap support may include a plurality of protrusion ribs, and if the insertion portion is inserted into the fixing groove, the plurality of protrusion ribs tightly contact at least one of the second bent portion and the front plate to cause the door cap support to be fixed on the door plate.

The door cap may include a recessed portion recessed in the down direction to form the gripping groove together with the bent portion, and a plurality of coupling hooks coupled with the door cap support.

The plurality of coupling hooks may include a plurality of first coupling hooks respectively disposed at both ends of the door cap, and a plurality of second coupling hooks disposed on a lower part of the recessed portion.

The coupling portion may include a plurality of coupling protrusions disposed to correspond to the first coupling hooks and coupled with the first coupling hooks, and a plurality of coupling holes disposed to correspond to the second coupling hooks and coupled with the second coupling hooks.

The coupling holes are disposed on a rear surface of the insertion portion inserted in the fixing groove, and if the second coupling hooks are coupled with the coupling holes, the second coupling hooks coupled with the coupling holes may be prevented from being exposed on the front surface of the refrigerator by the door plate.

In accordance with an aspect of the present disclosure, a door assembly for opening or closing a storage chamber of a refrigerator includes a door plate comprising a front plate, and a side plate bent in a rear direction from both side edges of the front plate; a door cap support fixed on a top of the door plate; and a door cap coupled with a top of the door cap support, and configured to cover the top of the door plate, wherein a bent portion is formed at a top end of the front plate so that the door cap support is fixed at the bent portion, and a coupling portion is formed at the door cap support so that the door cap is coupled with the coupling portion, the coupling portion positioned behind the bent portion.

The bent portion may include a first bent portion bent in the rear direction from the top end of the front plate to be at right angles with respect to the front plate, and a second bent portion bent downward from the first bent portion to be at right angles with respect to the first bent portion.

A fixing groove may be formed between the front plate and the second bent portion, the fixing groove opening in a down direction, so that the door cap support is inserted into the fixing groove from bottom to top and fixed at the fixing groove.

The door cap support may include an insertion portion inserted into the fixing groove, and a protrusion rib protruding from at least one of a front surface and a rear surface of the insertion portion.

The door cap support may include a plurality of protrusion ribs, and if the insertion portion is inserted into the fixing groove, the plurality of protrusion ribs tightly contact at least one of the second bent portion and the front plate to cause the door cap support to be fixed on the door plate.

The door cap may include a recessed portion recessed in the down direction to form a gripping groove opening in the up direction together with the bent portion, and a plurality of coupling hooks coupled with the door cap support.

The plurality of coupling hooks may include a plurality of first coupling hooks respectively disposed at both ends of the door cap, and a plurality of second coupling hooks disposed on a lower part of the recessed portion.

The coupling portion may include a plurality of coupling protrusions disposed to correspond to the first coupling hooks and coupled with the first coupling hooks, and a plurality of coupling holes disposed to correspond to the second coupling hooks and coupled with the second coupling hooks.

The coupling holes are disposed on a rear surface of the insertion portion inserted in the fixing groove, and if the second coupling hooks are coupled with the coupling holes, the second coupling hooks coupled with the coupling holes may be prevented from being exposed on the front surface of the refrigerator by the door plate.

Advantageous Effects

According to the embodiments of the present disclosure, a border made in a coupling area between the door plate and the door cap is not exposed on the front surface of the refrigerator so that the quality of the external appearance of the refrigerator can be improved.

BRIEF DESCRIPTION OF THE DRAWINGS

FIG. 1 is a perspective view of a refrigerator according to one embodiment of the present disclosure;

FIG. 2 is a view illustrating a state in which a door assembly of the refrigerator is separated according to one embodiment of the present disclosure;

FIG. 3 is a perspective view of a freezer compartment door assembly according to one embodiment of the present disclosure;

FIG. 4 is an exploded perspective view of the freezer compartment door assembly according to one embodiment of the present disclosure;

FIG. 5 is a view of a door plate, a door cap, and a door cap supporting part according to one embodiment of the present disclosure;

FIG. 6 is a view illustrating a state in which the door cap supporting part is fixed to the door plate according to one embodiment of the present disclosure;

FIG. 7 is a view illustrating a state in which the door cap is coupled to the door cap supporting part according to one embodiment of the present disclosure;

FIG. 8 is a view illustrating a state in which a first coupling hook and a second coupling hook of the door cap are coupled to a coupling protrusion and a coupling hole of the door cap supporting part, respectively, according to one embodiment of the present disclosure;

FIGS. 9 and 10 are views illustrating a state in which the second coupling hook of the door cap is coupled to the coupling hole of the door cap supporting part according to one embodiment of the present disclosure;

FIGS. 11 and 12 are views illustrating a state in which the first coupling hook of the door cap is coupled to the coupling protrusion of the door cap supporting part according to one embodiment of the present disclosure;

FIGS. 13 and 14 are views illustrating a state in which the door cap is coupled to a door plate of a refrigerator compartment door assembly according to one embodiment of the present disclosure;

FIG. 15 is a view illustrating a state in which a display unit is provided at the refrigerator compartment door assembly according to one embodiment of the present disclosure;

FIG. 16 is an exploded perspective view of the display unit and the refrigerator compartment door assembly according to one embodiment of the present disclosure;

FIG. 17 is an exploded perspective view of the display unit according to one embodiment of the present disclosure;

FIG. 18 is a view when FIG. 17 is seen from another direction according to one embodiment of the present disclosure;

FIG. 19 is a view illustrating a state in which a displaying part is coupled to a coupling portion according to one embodiment of the present disclosure;

FIG. 20 is a view illustrating a state in which a display installation part is coupled to the coupling portion according to one embodiment of the present disclosure;

FIG. 21 is a view illustrating a state in which the display installation part and the displaying part are coupled to the coupling portion according to one embodiment of the present disclosure;

FIG. 22 is a cross-sectional view of a portion at which a coupling rib of the display installation part is coupled into a first coupling hole of the coupling portion according to one embodiment of the present disclosure;

FIG. 23 is a cross-sectional view of a portion at which the second coupling hook of the displaying part is coupled into a second coupling hole of the coupling portion according to one embodiment of the present disclosure;

FIG. 24 is a view illustrating a state in which a gasket is being coupled to a rear surface of the freezer compartment door assembly according to one embodiment of the present disclosure;

FIG. 25 is a view illustrating a state in which a gasket is coupled to the rear surface of the freezer compartment door assembly according to one embodiment of the present disclosure;

FIG. 26 is a plane view of FIG. 25 according to one embodiment of the present disclosure;

FIG. 27 is a view of the gasket according to one embodiment of the present disclosure;

FIG. 28 is a view illustrating a state in which cooling air is prevented by a cooling air leakage preventing part of the gasket from leaking through a gap between a main body and the freezer compartment door assembly according to one embodiment of the present disclosure;

FIG. 29 illustrates a view of the gasket which is integrally extruded according to one embodiment of the present disclosure;

FIG. 30 illustrates a view of the gasket of FIG. 29 which is cut to have a length corresponding to each of upper and lower edges and left and right edges of the rear surface of the freezer compartment door assembly according to one embodiment of the present disclosure;

FIG. 31 illustrates a view of the gasket of FIG. 30 of which both ends are cut at an angle of 45 degrees according to one embodiment of the present disclosure;

FIG. 32 illustrates a view of a cooling air leakage preventing part of FIG. 31 of which both ends are partially cut according to one embodiment of the present disclosure;

FIG. 33 illustrates a view of a magnet being inserted in FIG. 32 according to one embodiment of the present disclosure; and FIG. 34 illustrates a view of the gasket of FIG. 33 being thermally bonded in a quadrangular shape corresponding to the edges of the rear surface of the freezer compartment door assembly according to one embodiment of the present disclosure.

BEST MODE

Hereinafter, embodiments of the present disclosure will be described in detail with reference to the accompanying drawings.

In the drawings, a "front direction" means a direction toward the front surface of a refrigerator from the rear surface, and a "rear direction" means a direction toward the rear surface of the refrigerator from the front surface.

As shown in FIGS. 1 and 2, a refrigerator may include a main body 10, a storage chamber 20 which is formed in the inside of the main body 10 and whose front part opens, and one or more door assemblies 100 and 200 rotatably coupled with the main body 10 and configured to open or close the opened front part of the storage chamber 20.

The main body 10 may include an inner cabinet 11 forming the storage chamber 20, an outer cabinet 13 coupled with the outer side of the inner cabinet 11 and forming the external appearance of the main body 10, and a cool-air supply apparatus (not shown) for supplying cool air to the storage chamber 20.

The cool-air supply apparatus may include a compressor, a condenser, an expansion valve, an evaporator, a blow fan, a cool-air duct, etc. An insulating material (not shown) may be filled between the inner cabinet 11 and the outer cabinet 13 of the main body 10 to prevent cool air in the storage chamber 20 from leaking out.

In the rear lower portion of the main body 10, a machine room (not shown) in which the compressor for compressing refrigerant and the condenser for condensing the compressed refrigerant are installed may be provided.

The storage chamber 20 may be partitioned into a refrigerating chamber 21 which is the upper storage chamber and a freezing chamber 23 which is the lower storage chamber, by a partition wall 15. In the refrigerating chamber 21 and the freezing chamber 23, a plurality of shelves 25 may be provided to partition the refrigerating chamber 21 and the freezing chamber 23 into a plurality of spaces to store food, etc.

Also, in the inside of the storage chamber 20, a storage container 27 may be provided to accommodate food, etc.

The storage chamber 20 may be opened or closed by the door assemblies 100 and 200 rotatably coupled with the main body 10. In the rear surface of the door assembly 200, a plurality of door guides 203 may be installed to accommodate food, etc.

The door assemblies 100 and 200 may be rotatably coupled with the main body 10 by a hinge unit 40, and the hinge unit 40 may include an upper hinge 41, a middle hinge 43, and a lower hinge 45.

In the rear surfaces of the door assemblies 100 and 200, a gasket 400 may be provided to maintain sealing between the main body 10 and the door assemblies 100 and 200 when the door assemblies 100 and 200 close, thus preventing cool air in the storage chamber 20 from leaking to the outside.

The door assemblies 100 and 200 may include a freezing chamber door assembly 100 to open or close the freezing chamber 23 which is the lower storage chamber, and a refrigerating chamber door assembly 200 to open or close the refrigerating chamber 21 which is the upper storage chamber.

As shown in FIGS. 3 to 5, the freezing chamber door assembly 100 for opening or closing the freezing chamber 23 may include a door plate 110 forming the front and side surfaces of the freezing chamber door assembly 100, a door cap 120 to cover the top of the door plate 110, and a door cap support 130 fixed on the door plate 110 and configured to support the door cap 120 so that the door cap 120 can be disposed on the top of the door plate 110.

The door plate 110 may include a front plate 111 forming the front surface of the freezing chamber door assembly 100, and a side plate 112 bent in the rear direction from both side edges of the front plate 111 and forming both side surfaces of the freezing chamber door assembly 100. A rear plate 117 may be coupled with the rear surface of the door plate 110 to form the rear surface of the freezing chamber door assembly 100.

At the top ends of the front plate 111 and the side plate 112, a bent portion 113 on which the door cap support 130 is fixed, and a fixing hole 112*a* may be respectively formed.

The bent portion 113 may include a first bent portion 114 bent in the rear direction from the top end of the front plate 111 to be at right angles with respect to the front plate 111, and a second bent portion 115 bent downward from the end of the first bent portion 114 to be at right angles with respect to the first bent portion 114.

Accordingly, a fixing groove 116 opening in the down direction may be formed between the front plate 111 and the second bent portion 115, and the door cap support 130 may be inserted into the fixing groove 116 from bottom to top and fixed at the fixing groove 116.

The door cap 120 may be coupled with the door cap support 130 fixed on the top of the door plate 110, instead of being directly coupled with the door plate 110, to cover the top of the door plate 110.

The door cap support 130 may include an insertion portion 131 inserted into the fixing groove 116, a plurality of protrusion ribs 132 protruding from the rear surface of the insertion portion 131, and a coupling portion 133 with which the door cap 120 is coupled.

If the insertion portion 131 of the door cap support 130 is inserted into the fixing groove 116, the plurality of protrusion ribs 132 connected to the insertion portion 131 may tightly contact the second bent portion 115 so as to cause the door cap support 130 to be fixed on the door plate 110.

In the drawings, the protrusion ribs 132 are arranged on the rear surface of the insertion portion 131 to tightly contact the second bent portion 115, however, the protrusion ribs 132 may be arranged on the front surface of the insertion portion 131 to tightly contact the front plate 111 of the door plate 110.

Also, in the door cap support 130, a fixing protrusion 136 may be provided. When the insertion portion 131 is inserted in the fixing groove 116, the fixing protrusion 136 may be fixed at the fixing hole 112*a* of the side plate 112.

There may be provided a plurality of coupling portions 133 to be coupled with the door cap 120. The plurality of coupling portions 133 may include a coupling protrusion 134 disposed to correspond to a first coupling hook 125 (will be described later) of the door cap 120 and coupled with the first coupling hook 125, and a plurality of coupling holes 135 disposed to correspond to a plurality of second coupling hooks 127 and coupled with the second coupling hooks 127.

The door cap 120 may cover the top of the door plate 110, and include a recessed portion 121 recessed in the down direction to form a gripping groove 101 together with the bent portion 113 of the door plate 110, and a plurality of coupling hooks 123 coupled with the door cap support 130.

If the door cap 120 is coupled with the door cap support 130, the gripping groove 101 may be positioned between the recessed portion 121 of the door cap 120 and the bent portion 113 of the door plate 110, and the gripping groove 101 may function as a handle gripped by a user to open or close the freezing chamber door assembly 100.

Accordingly, when the user opens or closes the freezing chamber door assembly 100, the user may put his/her hand into the gripping groove 101, and grip the bent portion 113 to open or close the freezing chamber door assembly 100.

The coupling hook 123 may include the first coupling hook 125 disposed at both ends of the door cap 120, and the plurality of second coupling hooks 127 disposed on the lower part of the recessed portion 121.

When the door cap 120 is coupled with the door cap support 130, the first coupling hook 125 may be coupled with the coupling protrusion 134 of the door cap support 130, and the second coupling hooks 127 may be coupled with the coupling holes 135 of the door cap support 130.

The coupling holes 135 of the door cap support 130 may be formed behind the insertion portion 131 inserted in the fixing groove 116, as described above. Accordingly, when the door cap 120 is coupled with the door cap support 130, the second coupling hooks 127 of the door cap 120 coupled with the coupling holes 135 of the door cap support 130 may be covered with the door plate 110 and thus not exposed on the front surface of the refrigerator.

Since a part at which the door cap 120 is coupled with the door cap support 130 is not exposed on the front surface of the refrigerator, the external appearance of the refrigerator can be simplified, which achieves the beautiful design of the refrigerator and prevents foreign materials from being collected into a gap of the part at which the door cap 120 is coupled with the door cap support 130.

At both ends of the door cap 120, hinge holes 129 may be formed into which a hinge shaft 43*a* of the middle hinge 43 is rotatably inserted, and at both ends of the door cap support 130 corresponding to the hinge holes 129, hinge grooves 137 may be formed into which the hinge shaft 43*a* is rotatably inserted.

In the drawings, the middle hinge 43 is disposed in the left portion of the main body 10, however, since the hinge holes 129 and the hinge grooves 137 are respectively formed at both ends of the door cap 120 and at both ends of the door cap support 130, the freezing chamber door assembly 100 can be applied regardless of the location of the middle hinge 43.

Now, operation in which the door plate 110, the door cap 120, and the door cap support 130 of the freezing chamber door assembly 100 are coupled with each other will be described with reference to FIGS. 6 to 12.

As shown in FIGS. 6 and 7, the door cap support 130 may move from bottom to top so that the insertion portion 131 is inserted into the fixing groove 116 opening in the down direction, and the plurality of protrusion ribs 132 protruding from the rear surface of the insertion portion 131 may tightly contact the second bent portion 115 so as to cause the door cap support 130 to be fixed on the door plate 110.

Also, when the insertion portion 131 is inserted into the fixing groove 116, the fixing protrusions 136 formed at both ends of the door cap support 130 may be inserted into and fixed at the fixing holes 112*a* formed in the side plate 112 so that the door cap support 130 is fixed on the door plate 110.

After the door cap support 130 is fixed on the door plate 110, the door cap 120 may move from top to bottom to be coupled with the door cap support 130.

As shown in FIG. 8, the door cap 120 may be coupled with the door cap support 130 by corresponding the first coupling hook 125 and the second coupling hooks 127 formed in the door cap 120 to the coupling protrusion 134 and the coupling holes 135 formed in the door cap support 130, respectively.

As shown in FIGS. 9 and 10, the second coupling hooks 127 of the door cap 120 may be inserted into and coupled with the coupling holes 135 of the door cap support 130, and as shown in FIGS. 11 and 12, the first coupling hook 125 of the door cap 120 may be coupled with the coupling protrusion 134 of the door cap support 130.

As shown in FIGS. 2, 13, and 14, the refrigerating chamber door assembly 200 for opening and closing the refrigerating chamber 21 may include a door plate 210 forming the front and side surfaces of the refrigerating chamber door assembly 200, and a door cap 220 to cover the top of the door plate 210.

The door plate 210 may include a front plate 211 forming the front surface of the refrigerating chamber door assembly 200, and a side plate 212 bent in the rear direction from both side edges of the front plate 211 and forming both side surfaces of the refrigerating chamber door assembly 200. A rear plate 219 (see FIG. 16) may be coupled with the rear surface of the door plate 210 to form the rear surface of the refrigerating chamber door assembly 200.

At the top end of the front plate 211, a bent portion 213 may be formed so that the door cap 220 is fixed at the bent portion 213. The bent portion 213 may include a first bent portion 214 bent in the rear direction from the top end of the front plate 211 to be at right angles with respect to the front plate 211, and a second bent portion 215 bent downward from the end of the first bent portion 214 to be at right angles with respect to the first bent portion 214.

Accordingly, a fixing groove 218 opening in the down direction may be formed between the front plate 211 and the second bent portion 215, and the door cap 220 may be inserted into the fixing groove 218 from bottom to top and coupled with the fixing groove 218.

In the second bent portion 215 and the side plate 212, a first coupling hole 216 and a second coupling hole 217 may be respectively formed so that the door cap 220 is coupled with the first coupling hole 216 and the second coupling hole 217.

The door cap 220 may cover the top of the door plate 210, and include an insertion portion 221 inserted in the fixing groove 218, and a first coupling protrusion 223 and a second coupling protrusion 225 coupled with the door plate 210.

The first coupling protrusion 223 and the second coupling protrusion 225 of the door cap 220 may be disposed to respectively correspond to the first coupling hole 216 and the second coupling hole 217 of the door plate 210 when the insertion portion 221 is inserted in the fixing groove 218.

Accordingly, when the insertion portion 221 of the door cap 220 is inserted in the fixing groove 218, the first coupling protrusion 223 may be coupled with the first coupling hole 216, and the second coupling protrusion 225 may be coupled with the second coupling hole 217.

Since the first coupling protrusion 223 and the first coupling hole 216 as components for coupling the front plate 211 of the door plate 210 with the door cap 220 are positioned behind the bent portion 213, the first coupling protrusion 223 coupled with the first coupling hole 216 when the door cap 220 is coupled with the door plate 210 may be not exposed on the front surface of the refrigerating chamber door assembly 200.

Since a part at which the door plate 210 is coupled with the door cap 220 is not exposed on the front surface of the refrigerator, the external appearance of the refrigerator can be simplified, which achieves the beautiful design of the refrigerator and prevents foreign materials from being collected into a gap of the part at which the door plate 210 is coupled with the door cap 220.

As shown in FIGS. 2 and 15, the refrigerating chamber door assembly 200 may include a display unit 300.

As shown in FIGS. 15 and 16, the refrigerating chamber door assembly 200 may include the door plate 210 forming the front and side surfaces of the refrigerating chamber door assembly 200, and the rear plate 219 forming the rear surface of the door plate 210, wherein an insulating material (not shown) U may be filled between the door plate 210 and the rear plate 219 (see FIGS. 22 and 23).

In the front surface of the door plate 210, an opening 230 for exposing the front surface of the display unit 300 to the outside may be formed.

A coupling portion 240 may be formed along the edges of the opening 230 in such a way to be bent toward the inside of the door plate 210. A display installing member 310 and a display member 320 which will be described later may be coupled with the coupling portion 240.

The display unit 300 may display operation information of the refrigerator, or receive operation commands of the refrigerator.

As shown in FIGS. 17 to 23, the display unit 300 may include the display installing member 310 in which a display 311 is installed, the display member 320 disposed in front of the display installing member 310 and configured to display operation information displayed on the display 311 to the outside, and a sealing member 330 configured to seal between the display installing member 310 and the display member 320 to prevent moisture from getting in the inside of the display unit 300.

The display installing member 310 may be disposed in the inside of the refrigerating chamber door assembly 200 in correspondence to the opening 230 provided in the front surface of the door plate 210.

The display installing member 310 may include a plurality of coupling ribs 313 coupled with the coupling portion 240 bent along the edges of the opening 230, a sealing portion 315 tightly contacting the rear surface of the door plate 210 and configured to prevent the insulating material U from getting in the inside of the display installing member 310, and a protrusion rib 317 disposed to correspond to a resting groove 327 of the display member 320 which will be described later.

The plurality of coupling ribs 313 may be disposed at both sides of the display installing member 310. In both sides of the coupling portion 240, a plurality of first coupling holes 241 may be formed to be coupled with the plurality of coupling ribs 313.

The sealing portion 315 may tightly contact the rear surface of the front plate 211 of the door plate 210, when the display installing member 310 is coupled with the coupling portion 240, to prevent the installing material U filled in the inside of the refrigerating chamber door assembly 200 from getting in the inside of the display installing member 310.

The display member 320 may be disposed in front of the display installing member 310, and exposed to the outside through the opening 230 formed in the front surface of the door plate 210.

The front surface of the display member 320 exposed to the outside through the opening 230 may be made of a transparent material so that operation information displayed on the display 311 can be identified from the outside.

The display member 320 may include a plurality of coupling hooks 321 coupled with the coupling portion 240, and a resting groove 327 on which the sealing member 330 is rested.

The coupling hooks 321 may include a plurality of first coupling hooks 323 respectively disposed on the upper and lower portions of the display member 320, and a plurality of second coupling hooks 325 arranged on both sides of the display member 320.

The first coupling hooks 323 may be coupled with the upper and lower parts of the coupling portion 240, and a plurality of second coupling holes 243 may be formed in both sides of the coupling portion 240 to be coupled with the second coupling hooks 325.

In the both sides of the coupling member 240, a plurality of first coupling holes 241 may be formed to be coupled with the coupling ribs 323 of the display installing member 310, and the plurality of second coupling holes 243 may be formed to be coupled with the second coupling hooks 325 of the display member 320, wherein the second coupling holes 243 and the first coupling holes 241 may be arranged alternately. FIG. 22 is a cross-sectional view showing a part at which the coupling ribs 313 of the display installing member 310 are coupled with the first coupling holes 241, and FIG. 23 is a cross-sectional view showing a part at which the second coupling hooks 325 of the display member 320 is coupled with the second coupling holes 243.

If the sealing member 330 is rested in the resting groove 327 of the display member 320, and the display installing member 310 is coupled with the coupling portion 240 of the display member 320, the protruding ribs 317 of the display installing member 310 may be inserted into the resting groove 327 to press the sealing member 330 since the protruding ribs 317 of the display installing member 310 are disposed to correspond to the resting groove 327.

Since the sealing member 330 is pressed by the protruding ribs 317 and the resting groove 327, the display installing member 310 may tightly contact the display member 320 by the sealing member 330 to thus prevent moisture from getting in the inside of the display unit 300.

Since the inside of the refrigerating chamber 21 is maintained at lower temperature than the outside temperature, temperature of the front surface of the refrigerating chamber door assembly 200 contacting the outside of the refrigerating chamber 21 may also become lower than the outside temperature through heat exchange.

If the temperature of air containing water vapor falls down, relative humidity increases to reach 100%, and at this time, the water vapor starts being condensed. Temperature at which the water vapor starts being condensed is called dew-point temperature.

An area of the front surface of the refrigerating chamber door assembly 200 at which the display unit 300 is disposed is thinner than the other area. Accordingly, if temperature of the front surface of the refrigerating chamber door assembly 200 falls down to reach the dew-point temperature, water vapor may be condensed to form dew on the front surface of the refrigerating chamber door assembly 200.

Since the display member 320 is exposed on the front surface of the refrigerating chamber door assembly 200, dew formed on the front surface of the refrigerating chamber door assembly 200 may get in the inside of the display unit 300. However, since the display installing member 310 and the display member 320 are sealed by the sealing member 330, no moisture may get in the inside of the display unit 300, thereby preventing electrical damage or wrong operation of the display unit 300 that may be caused by moisture got in the inside of the display unit 300.

Also, since moisture is prevented from getting in the inside of the display unit 300, the display unit 300 can be maintained at low humidity.

Since dry air has lower dew-point temperature than humid air, the humidity of the display member 320 can be lowered if the humidity of the display unit 300 is lowered, thereby minimizing dew formation on the display member 320.

As shown in FIG. 1, the gasket 400 for sealing between the main body 10 and the door assemblies 100 and 200 when the door assemblies 100 and 200 close may be coupled with the rear surfaces of the door assemblies 100 and 200.

The configuration in which the gasket 400 is coupled with the rear surfaces of the door assemblies 100 and 200 will be, for convenience of description, described as a configuration in which the gasket 400 is coupled with the rear surface of the freezing chamber door assembly 100.

As shown in FIGS. 24 to 26, the gasket 400 may be fabricated as an injection-molded body, and coupled with the rear surface of the door assembly 100. When the door assembly 100 closes, the gasket 400 may maintain sealing between the main body 10 and the door assembly 100 to prevent cool air in the freezing chamber 23 from leaking to the outside.

The gasket 400 may include a upper gasket 401 coupled with the upper portion of the rear surface of the door assembly 100, a lower gasket 403 coupled with the lower portion of the rear surface of the door assembly 100, a left gasket 405 coupled with the left portion of the rear surface of the door assembly 100, and a right gasket 407 coupled with the right portion of the rear surface of the door assembly 100.

As shown in FIG. 27, the gasket 400 may include a coupling portion 410 coupled with the rear surface of the door assembly 100, a sealing member 420 tightly contacting the main body 10 to maintain sealing between the main body and the door assembly 100 when the door assembly 100 closes, and a cool-air leakage preventing member 430 extending from one end of the sealing member 420 toward the freezing chamber 23 and configured to prevent cool air from leaking through a gap between the main body 10 and the door assembly 100.

On the rear surface of the door assembly 100, as shown in FIG. 24, a coupling groove 105 may be formed to be coupled with the gasket 400, and the coupling portion 410 of the gasket 400 may be coupled with the coupling groove 105.

The sealing member 420 may include a contact portion 421 contacting the main body 10 when the door assembly 100 closes, a shock absorbing portion 423 configured to absorb a shock generated between the main body 10 and the door assembly 100 when the door assembly 100 closes, and a magnet accommodating portion 425 configured to accommodate a magnet 440 for causing the door assembly 100 to tightly contact the main body 10.

The cool-air leakage preventing member 430 may be shorter than the sealing member 420, and prevent cool air in the freezing chamber 23 from leaking through a gap between the main body 10 and the door assembly 100.

As shown in FIG. 28, since the sealing member 420 prevents cool air in the freezing chamber 23 from leaking through the gap between the main body and the door assembly 100, and the cool-air leakage preventing member 430 extending from the sealing member 420 seals off the gap between the main body 10 and the door assembly 100, it is possible to minimize leakage of cool air in the freezing chamber 23 through the gap between the main body 10 and the door assembly 100.

Hereinafter, a method of manufacturing the gasket 400 will be described with reference to FIGS. 29 to 34.

As shown in FIG. 29, the gasket 400 may be molded as one body having the coupling portion 410, the sealing member 420, and the cool-air leakage preventing member 430 by extrusion molding.

The gasket 400 extrusion-molded as one body may be, as shown in FIG. 30, cut off to several gaskets having lengths corresponding to the upper, lower, left, and right edges of the rear surface of the door assembly 100.

After the gasket 400 is cut off to several gaskets having lengths corresponding to the upper, lower, left, and right edges of the rear surface of the door assembly 100, both ends of each gasket 400 may be, as shown in FIG. 31, cut off at an angle of 45 degrees so that the gaskets 400 can be bonded to form a quadrangle corresponding to the edges of the rear surface of the door assembly 100.

After both ends of each gasket 400 are cut off at the angle of 45 degrees, both ends of the cool-air leakage preventing member 430 may be, as shown in FIG. 32, cut off such that the cool-air leakage preventing member 430 is shorter than the sealing member 420.

The cut-off length of the cool air leakage preventing member 430 may be preferably about 30 mm.

The gaskets 400 whose both ends are cut off at the angle of 45 degrees may be bonded to each other by thermosetting to form a quadrangle corresponding to the edges of the rear surface of the door assembly 100. However, since it is not easy to bond the sections of the gaskets 400 including all of the coupling portion 410, the sealing member 420, and the cool-air leakage preventing member 430 by thermosetting when the gaskets 400 are bonded by thermosetting, only the coupling portion 410 and the sealing member 420 may be bonded by thermosetting after both ends of the cool-air leakage preventing member 430 are cut off.

After both ends of the cool-air leakage preventing member 430 are cut off, the magnet 440 may be inserted into the magnet accommodating portion 425 of the sealing member 420, as shown in FIG. 33.

After the magnet 440 is inserted into the inside of the sealing member 420, the gaskets 400 may be, as shown in FIG. 34, bonded by thermosetting to form a quadrangle, and then coupled with the rear surface of the door assembly 100.

Although the refrigerator and the display unit of the refrigerator have been described above with respect to specific shapes and directions with reference to the accompanying drawings, it will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

The invention claimed is:

1. A refrigerator comprising:

a main body;

a storage chamber formed in an inside of the main body, wherein a front part of the storage chamber opens; and a door assembly rotatably coupled with the main body, and configured to open and close the open front part of the storage chamber, wherein the door assembly comprises:

a door plate including a front plate and a side plate bent in a rear direction from both side edges of the front plate, wherein a bent portion is formed in an upper end of the front plate, a door cap configured to cover a top of the door plate, wherein a gripping groove is formed between the door cap and the bent portion, the gripping groove opening in an up direction, and a door cap support including a coupling portion coupled with the door cap, and fixed at the bent portion such that the coupling portion is positioned behind the bent portion.

2. The refrigerator according to claim 1, wherein the bent portion comprises a first bent portion bent in the rear direction from a top end of the front plate to be perpendicular to the front plate, and a second bent portion bent downward from an end of the first bent portion to be perpendicular to the first bent portion.

3. The refrigerator according to claim 2, wherein a fixing groove is formed between the front plate and the second bent portion, the fixing groove opening in a down direction, so that the door cap support is inserted into the fixing groove from bottom to top and fixed at the fixing groove.

4. The refrigerator according to claim 3, wherein the door cap support comprises an insertion portion inserted into the fixing groove, and a protrusion rib protruding from at least one of a front surface and a rear surface of the insertion portion.

5. The refrigerator according to claim 4, wherein the door cap support comprises a plurality of the protrusion ribs, and if the insertion portion is inserted into the fixing groove, the plurality of the protrusion ribs tightly contact at least one of the second bent portion and the front plate to cause the door cap support to be fixed on the door plate.

6. The refrigerator according to claim 5, wherein the plurality of coupling hooks comprises a plurality of first coupling hooks respectively disposed at both ends of the door cap, and a plurality of second coupling hooks disposed on a lower part of the recessed portion.

7. The refrigerator according to claim 6, wherein the coupling portion comprises a plurality of coupling protrusions disposed to correspond to the first coupling hooks and coupled with the first coupling hooks, and a plurality of coupling holes disposed to correspond to the second coupling hooks and coupled with the second coupling hooks.

8. The refrigerator according to claim 7, wherein the coupling holes are disposed on a rear surface of the insertion portion inserted in the fixing groove, and if the second coupling hooks are coupled with the coupling holes, the second coupling hooks coupled with the coupling holes are prevented from being exposed on the front surface of the refrigerator by the door plate.

9. A door assembly for opening or closing a storage chamber of a refrigerator, the door assembly comprising:

a door plate comprising a front plate, and a side plate bent in a rear direction from both side edges of the front plate;

a door cap support fixed on an upper portion of the door plate; and a door cap coupled with a top of the door cap support, and configured to cover a top of the door plate, wherein a bent portion is formed at a top end of the front plate so that the door cap support is fixed at the bent portion, and a coupling portion is formed at the door cap support so that the door cap is coupled with the coupling portion, the coupling portion positioned behind the bent portion, and wherein the door cap comprises a recessed portion recessed in a down direction to form a gripping groove opening in an up direction together with the bent portion, and a plurality of coupling hooks coupled with the door cap support.

10. The door assembly according to claim 9, wherein the bent portion comprises a first bent portion bent in the rear direction from the top end of the front plate to be perpendicular to the front plate, and a second bent portion bent downward from the first bent portion to be perpendicular to the first bent portion.

11. The door assembly according to claim 10, wherein a fixing groove is formed between the front plate and the second bent portion, the fixing groove opening in a down direction, so that the door cap support is inserted into the fixing groove from bottom to top and fixed at the fixing groove.

12. The door assembly according to claim 11, wherein the door cap support comprises an insertion portion inserted into the fixing groove, and a protrusion rib protruding from at least one of a front surface and a rear surface of the insertion portion.

13. The door assembly according to claim 12, wherein the door cap support comprises a plurality of the protrusion ribs, and if the insertion portion is inserted into the fixing groove, the plurality of the protrusion ribs tightly contact at least one of the second bent portion and the front plate to cause the door cap support to be fixed on the door plate.

14. The door assembly according to claim 13, wherein the plurality of coupling hooks comprises a plurality of first coupling hooks respectively disposed at both ends of the door cap, and a plurality of second coupling hooks disposed on a lower part of the recessed portion.

15. The door assembly according to claim 14, wherein the coupling portion comprises a plurality of coupling protrusions disposed to correspond to the first coupling hooks and coupled with the first coupling hooks, and a plurality of coupling holes disposed to correspond to the second coupling hooks and coupled with the second coupling hooks.

16. The door assembly according to claim 15, wherein the plurality of coupling holes are disposed on a rear surface of the insertion portion inserted in the fixing groove, and if the plurality of second coupling hooks are coupled with the plurality of coupling holes, the plurality of second coupling hooks coupled with the plurality of coupling holes are covered by the door plate.

* * * * *